US008522498B2

(12) United States Patent
Picken

(10) Patent No.: US 8,522,498 B2
(45) Date of Patent: Sep. 3, 2013

(54) SYSTEM AND METHOD FOR REMOVABLY CONNECTING TRIM TO A WALL OR CEILING OR BOTH

(76) Inventor: Heath D. Picken, Johnston, IA (US)

( * ) Notice: Subject to any disclaimer, the term of this patent is extended or adjusted under 35 U.S.C. 154(b) by 12 days.

(21) Appl. No.: 13/121,971

(22) PCT Filed: Oct. 4, 2008

(86) PCT No.: PCT/US2008/011475

§ 371 (c)(1),
(2), (4) Date: Mar. 31, 2011

(87) PCT Pub. No.: WO2010/039110

PCT Pub. Date: Apr. 8, 2010

(65) Prior Publication Data

US 2011/0179733 A1 Jul. 28, 2011

(51) Int. Cl.
*E04B 2/00* (2006.01)

(52) U.S. Cl.
USPC ..... 52/287.1

(58) Field of Classification Search
USPC ..... 52/716.1, 716.3, 716.4, 716.8, 717.01, 52/717.05, 717.06, 718.01, 718.04
See application file for complete search history.

(56) References Cited

U.S. PATENT DOCUMENTS 2,132,400 A * 10/1938 Curren ..... 174/72 C
4,891,922 A * 1/1990 Hozer et al. ..... 52/239
5,024,614 A * 6/1991 Dola et al. ..... 439/114
5,336,849 A * 8/1994 Whitney ..... 174/72 C
5,359,817 A * 11/1994 Fulton ..... 52/288.1
5,523,529 A * 6/1996 Holliday ..... 174/101
5,694,726 A * 12/1997 Wu ..... 52/287.1
5,831,211 A * 11/1998 Gartung et al. ..... 174/498
5,927,041 A * 7/1999 Sedlmeier et al. ..... 52/836
6,253,509 B1 * 7/2001 Hellwig et al. ..... 52/239
6,276,101 B1 * 8/2001 Schiedegger et al. ..... 52/211
6,279,278 B1 * 8/2001 Morris et al. ..... 52/239
6,513,288 B1 * 2/2003 MacDonald et al. ..... 52/239
6,625,950 B1 * 9/2003 Shreiner et al. ..... 52/718.01
6,786,016 B1 * 9/2004 Wood ..... 52/290
7,461,484 B2 * 12/2008 Battey et al. ..... 52/220.7
2004/0040235 A1 * 3/2004 Kurtz ..... 52/288.1

* cited by examiner

*Primary Examiner* — Joshua J Michener
*Assistant Examiner* — Keith Minter
(74) *Attorney, Agent, or Firm* — Antonio Papageorgiou; Ostrow Kaufman LLP

(57) ABSTRACT

A bracket system is disclosed for allowing conventional trim to be removably connected to a wall or ceiling or both while allowing the bracket system to be concealed behind the trim. The bracket system includes a wall bracket that is attached to the wall or ceiling or both and a trim bracket that is attached to conventional trim. The wall bracket and trim bracket interlock with each other and are held together in secure but removable mating contact. The wall bracket and trim bracket can be pulled apart or pushed together to allow for removal and reinstallation of trim without mechanical modification or destruction of any components. A preferred embodiment of the bracket system includes an insert bracket that is placed inside and concealed within the wall bracket. The insert bracket helps to retain cabling within the wall bracket when the trim bracket is removed or to keep cabling running along the bracket system separated.

38 Claims, 17 Drawing Sheets

SYSTEM AND METHOD FOR REMOVABLY CONNECTING TRIM TO A WALL OR CEILING OR BOTH

RELATED APPLICATION

This application is a national stage of International Application No. PCT/US2008/011475 filed Oct. 4, 2008, which is hereby incorporated herein by reference.

BACKGROUND OF THE INVENTION

1. Field of the Invention

This invention relates to devices and methods for removably connecting trim to a wall or ceiling or both.

2. Description of Related Art

There are two main purposes of trim carpentry. The first is to cover up all the rough edges left over from the construction of a house or other building. The other main purpose is to add a decorative and finished look to the walls, doors and windows of the house or other building. Thus, trim carpentry is an important part of the presentation of a home or building.

Installing trim is a difficult and demanding job. Typically, individual pieces of trim are cut and nailed into place more or less permanently affixing the trim to a wall or ceiling or around a door or window. The holes produced in the trim by driving nails through the trim require puttying to fill the holes and sanding to prepare the trim for painting, staining or other coating. This difficult process is made more difficult by the fact that walls, floors, ceilings and door and window frames are seldom flat, straight and square.

Further, the flatness, straightness and squareness of these items often changes over time as the building shifts or settles. In addition, it is often desirable to remove or replace pieces of trim to give a new appearance or to replace damaged or worn pieces. Also, it is often desirable to have access to a wall or ceiling behind a piece of trim in order to access the wall or ceiling or a cavity behind the wall or ceiling or to run wires or cabling behind the trim. As a result, it is often necessary or desirable or both to remove pieces of trim previously permanently affixed. At best this usually results in a difficult process especially when trying to preserve the piece of trim to be removed. Often the trim piece is damaged in the removal process. If a trim piece is reused, the original nails have to be cut off or removed or both and the existing nail holes or new holes created by the new nails or both have to be filled with putty and sanded.

In view of the foregoing, it is desirable to be able to easily remove and reinstall trim.

SUMMARY OF THE INVENTION

A bracket system is disclosed for allowing conventional trim to be removably connected to a wall or ceiling or both. The bracket system includes a wall bracket that is attached to the wall or ceiling or both and a trim bracket that is attached to conventional trim. The wall bracket and trim bracket interlock with each other and are held securely together by a removable mating contact. The wall bracket and trim bracket can be pulled apart and pushed together to allow for removal and reinstallation of trim without mechanical modification or destruction of any components.

A preferred embodiment of the bracket system includes an insert bracket that is placed inside and concealed within the wall bracket. The insert bracket helps to retain cabling within the wall bracket when the trim bracket is removed or to keep cabling running along the bracket system separated.

Various objects and advantages of the invention will be clear in view of the following description to the invention including the associated drawings.

BRIEF DESCRIPTION OF THE FIGURES

The invention will be described hereafter in detail with particular reference to the drawings. Throughout this description, like elements, in whatever embodiment described, refer to common elements wherever referred to and referenced by the same reference number. The characteristics, attributes, functions, interrelations ascribed to a particular element in one location apply to that element when referred to by the same reference number in another location unless specifically stated otherwise. All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength and similar requirements will likewise be within the skill of the art after the following description has been read and understood.

DETAILED DESCRIPTION OF THE INVENTION

Figure 1:
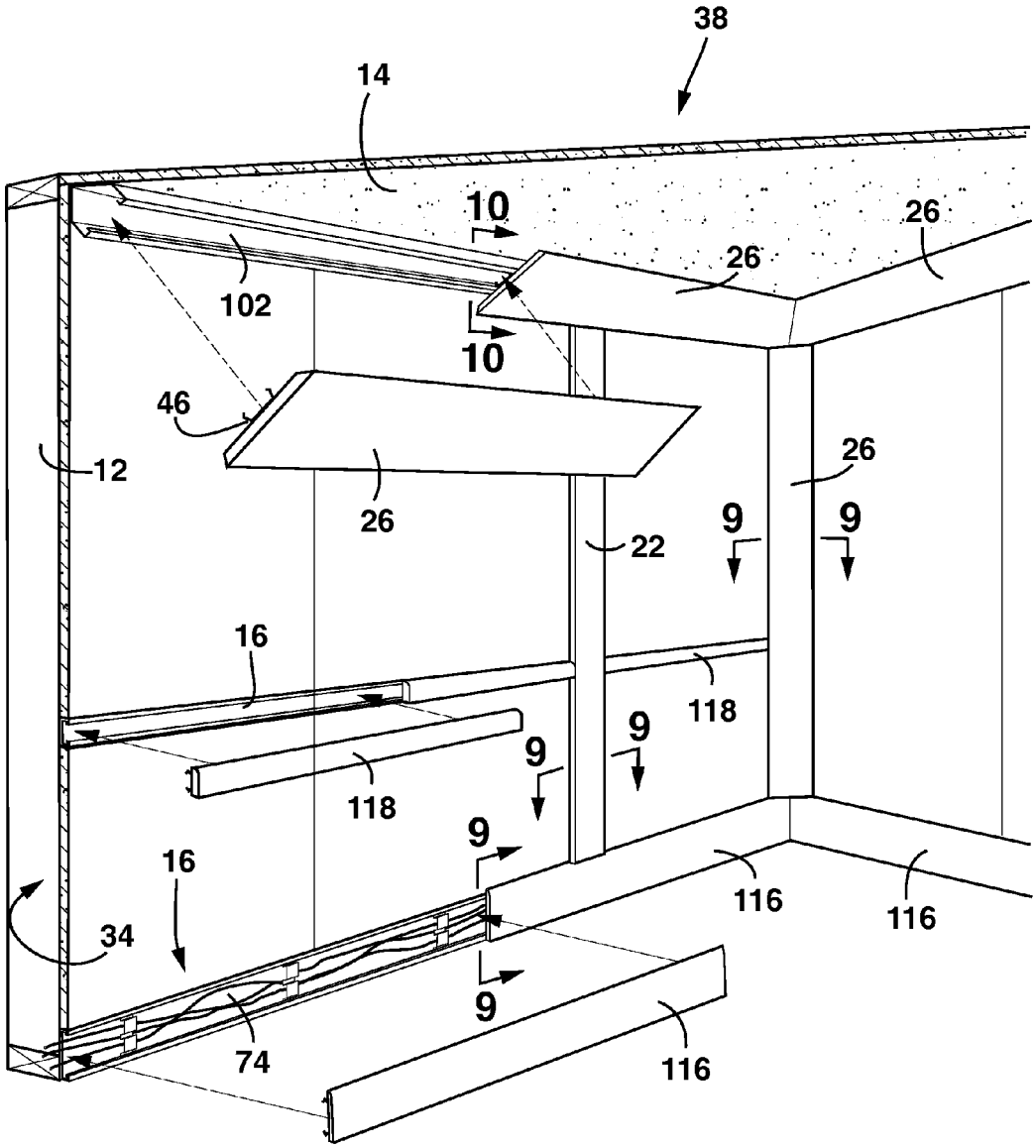
FIG. 1 is a perspective view of the bracket system of the present invention in place on a wall and a ceiling.
Figure 2A:
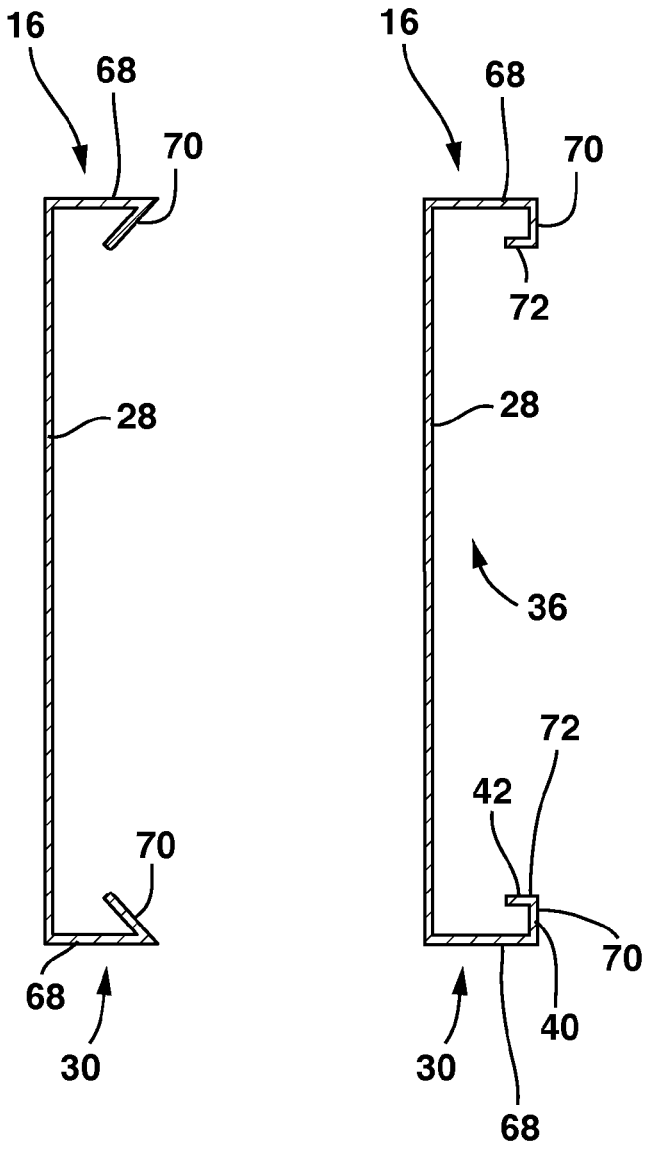
FIGS. 2A-2D are end views of multiple embodiments of the wall bracket, multiple embodiments of the trim bracket and multiple embodiments of the insert bracket of the present invention.
Figure 2B:
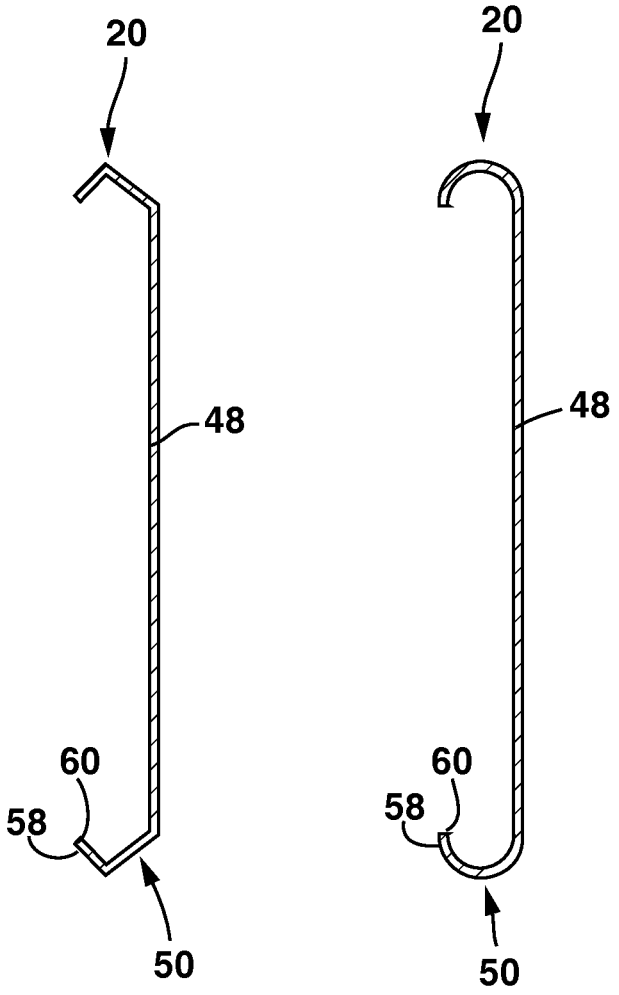
Figure 2C:
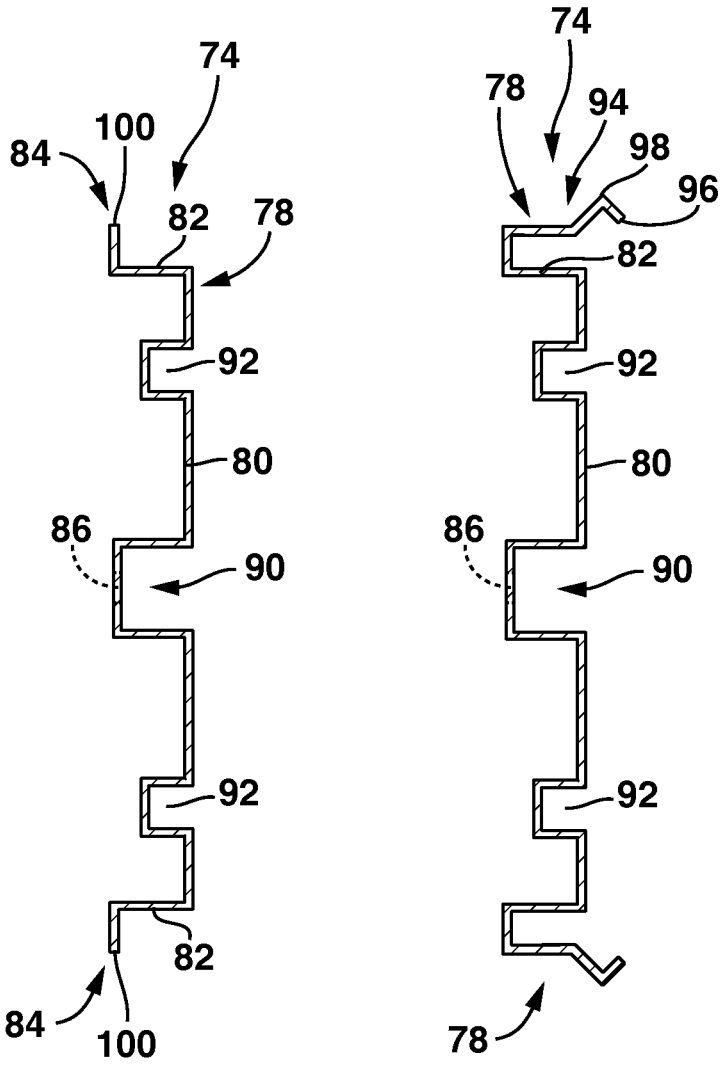
Figure 2D:
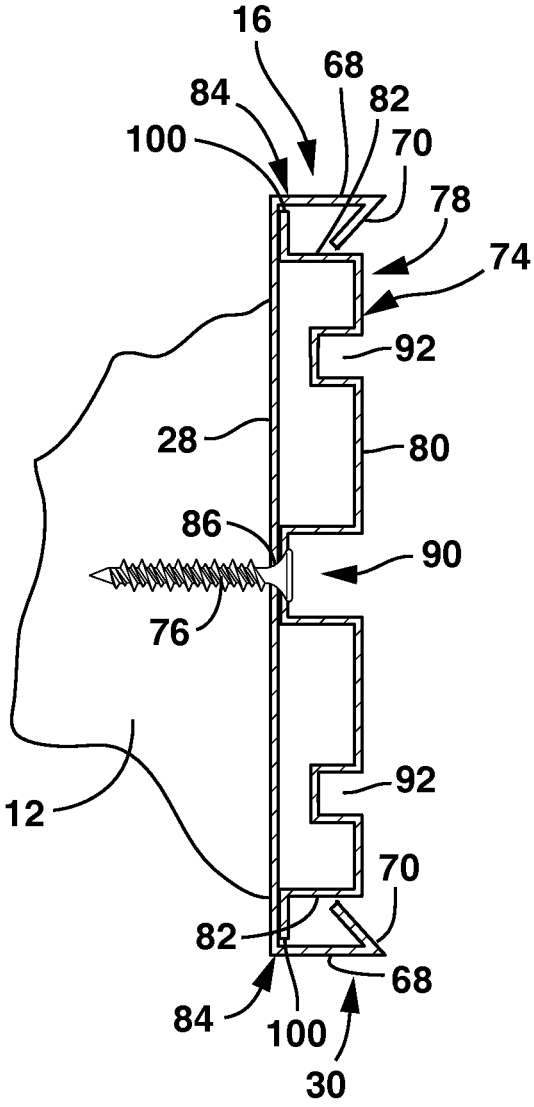

A concealed bracket system is disclosed generally referred to by the reference number 10. The bracket system 10 is used to attach conventional trim to a wall 12 or ceiling 14. The bracket system 10 has two primary parts, a wall bracket 16 that attaches to the wall 12 or ceiling 14 or both with wall bracket fasteners 18. The second part, a trim bracket 20, attaches to conventional trim 22 with trim bracket fasteners 24. The wall bracket 16 and trim bracket 20 interlock with each other and are held together in mating contact. The wall bracket 16 and trim bracket 20 can be pulled apart or pushed together to allow for removal and reinstallation of trim 22 without mechanical modification or destruction of any components.

The wall bracket 16 is preferably concealed and attached to a wall 12 or ceiling 14 or both constructed of wood studs, metal studs, gypsum board, plaster, stucco, wood paneling or any other type of wall construction material. The wall bracket 16 may be recessed from or flush with the face of the finished wall 12 or ceiling 14 or may project out from the finished wall 12 or ceiling 14 but still be concealed by the trim 22 as in the case of installation in a corner where crown molding 26 would bridge across the two walls 12 or wall 12 and ceiling 14 surfaces to fully conceal the wall bracket 16.

Figure 6:
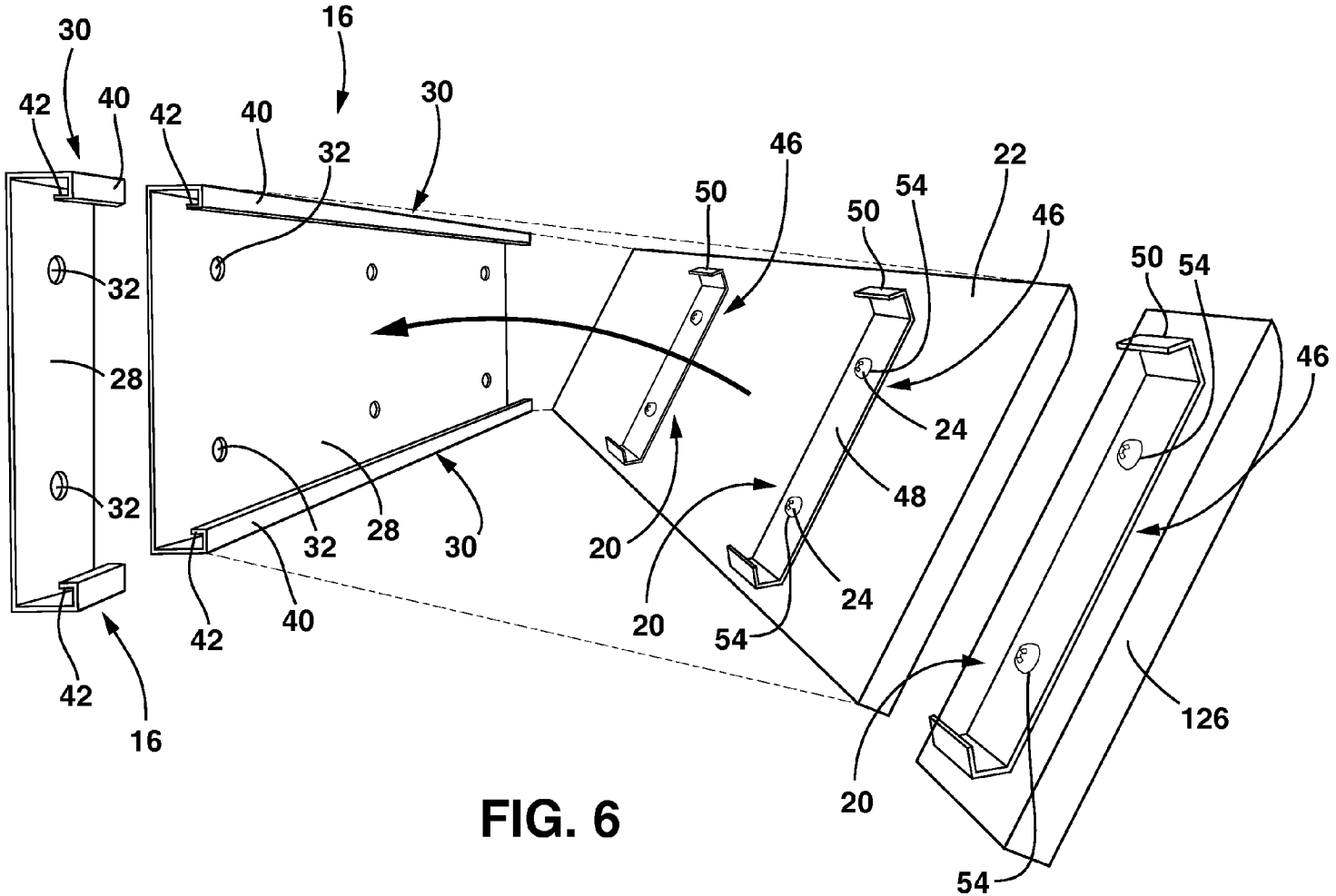
FIG. 6 is an end perspective view of an embodiment of the wall bracket and the trim bracket as they move into mating and locking contact.

As can be seen in FIGS. 2 and 6, the wall bracket 16 in a preferred embodiment includes a backplate 28 and a pair of opposed wall bracket retaining fingers 30. The backplate 28 in a preferred embodiment is essentially a long, flat, planar piece that is attached to a wall 12 or ceiling 14 by wall bracket fasteners 18.

In a preferred embodiment of the wall bracket 16, the backplate 28 has no preformed holes extending through the backplate 28 to receive wall bracket fasteners 18 that pass through the preformed holes into a wall 12 or ceiling 14 to hold the backplate 28 in firm contact with the wall 12 or ceiling 14. Instead, the backplate 28 in this embodiment is made of a material such as a thin metal or other similar material that can be easily penetrated by standard screws or nails without requiring that there be a preformed hole or that a pilot hole be drilled. In this embodiment, wall bracket fasteners 18 are used but, because the person fastening the backplate 28 to a wall usually has a solid wall or ceiling to push against when screwing in the wall bracket fastener 18, there is no need to precisely locate holes for receiving the wall bracket fasteners 18.

In another embodiment of the wall bracket 16, the backplate 28 has one or more backplate holes 32 extending through the backplate 28 to receive wall bracket fasteners 18 that pass through the backplate holes 32 into a wall 12 or ceiling 14 to hold the backplate 28 in firm contact with the wall 12 or ceiling 14. The backplate holes 32 in this embodiment would typically be at predetermined intervals such as a 16" separation corresponding to the 16" center to center span of standard wall studs or floor joists to match up with normal wall stud or floor joist spacing in typical construction. Of course, if the wall stud or floor joist spacing varied from the spacing of the backplate holes 32 based on a standard spacing dimension, which it often does, the preformed backplate holes 32 wouldn't be aligned with the existing wall studs or floor joists. Consequently, this embodiment of the backplate 28 will have particular utility to those situations where the wall stud or floor joist spacing is typical or where the wall stud or floor joist spacing is known in advance and, in either case, where the dimensions and relative location of the backplate 28 with respect to a wall 12 or ceiling 14 is known in advance.

Where backplate holes 32 are used, the backplate holes 32 can be vertically slotted type holes, if desired, that would allow easy vertical adjustment of the wall bracket 16 without moving the existing wall bracket fasteners 18. The wall bracket 16 may also be manufactured with backplate holes 32 to accommodate passage of cabling from a wall cavity 34 to within the cavity 36 of the wall bracket 16. The backplate holes 32 may also be of a common shape that would allow easy attachment of readily available conduit that may be installed within the wall cavity 34 or a ceiling cavity 38. Of course, the backplate 28 may be made of a material such as a thin metal or other similar material that can be easily penetrated by standard screws and also have preformed backplate holes 32.

The wall bracket 16 may be flexible to allow the wall bracket 16 to follow and conform to the shape of a curved wall 12 or ceiling 14 to which it is attached. The wall bracket 16 may itself be made of a flexible material (FIG. 7) or may be segmented (FIG. 8) to allow the wall bracket 16 to be flexible. In the embodiment of the wall bracket 16 shown in FIG. 8, the backplate 28 is comprised of two or more backplate segments 28' so that each backplate segment 28' is connected to its adjacent backplate segment 28' through a hinge 52 (e.g., a living hinge) that allows each backplate segment 28' to pivot around the hinge 52 to follow the curvature of the wall. Each backplate segment 28' can be either rigid or flexible as desired. Each backplate segment 28' also has a pair of opposed wall bracket retaining fingers 30 extending away from it as described herein. Each pair of opposed wall bracket retaining fingers 30 is sized to have a width corresponding roughly with the width of each backplate segment 28'. It is also within the scope of the invention for a backplate 28 to have material removed to make the backplate 28 more flexible or to reduce the cost or weight of the material of the backplate 28.

Figure 9:
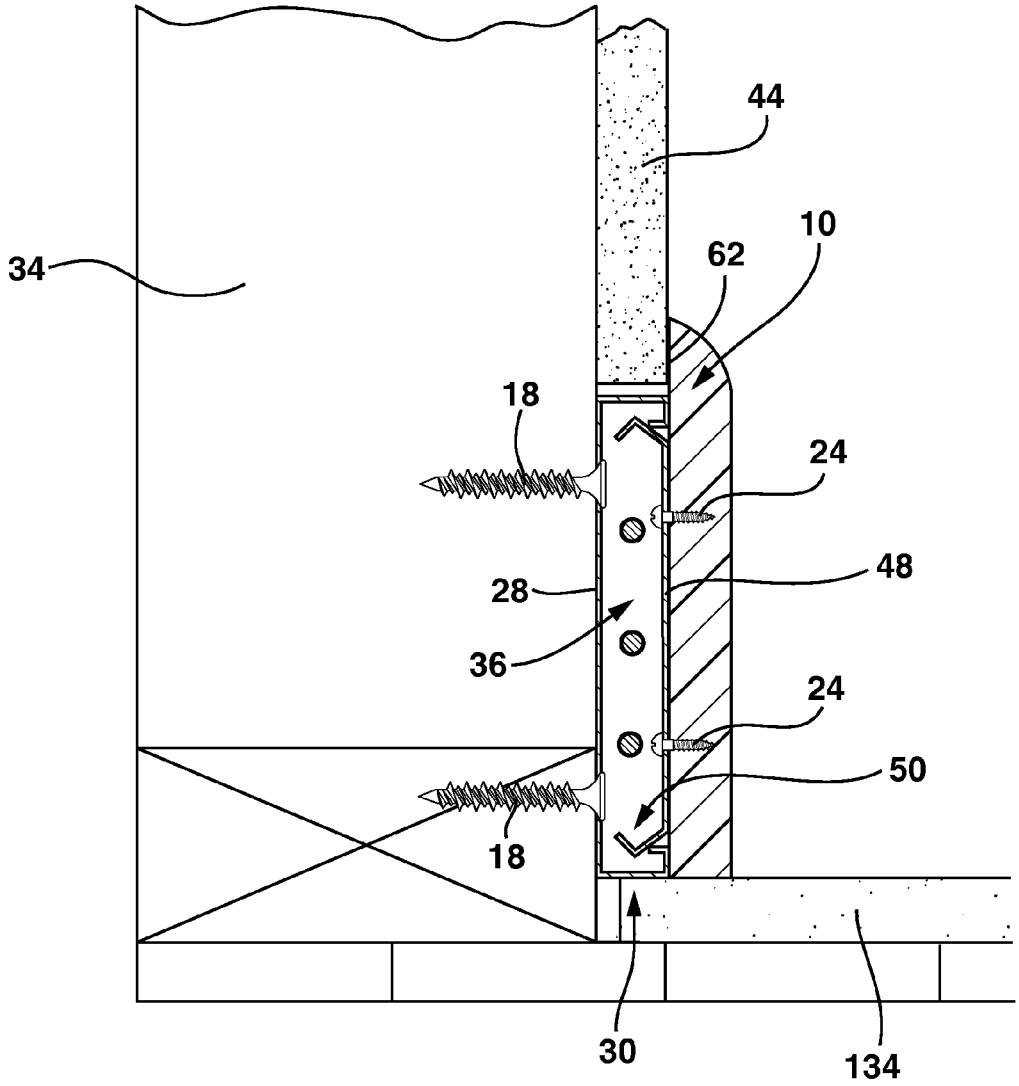
FIG. 9 is an end view of the bracket system of the present invention in place on a wall.
Figure 10:
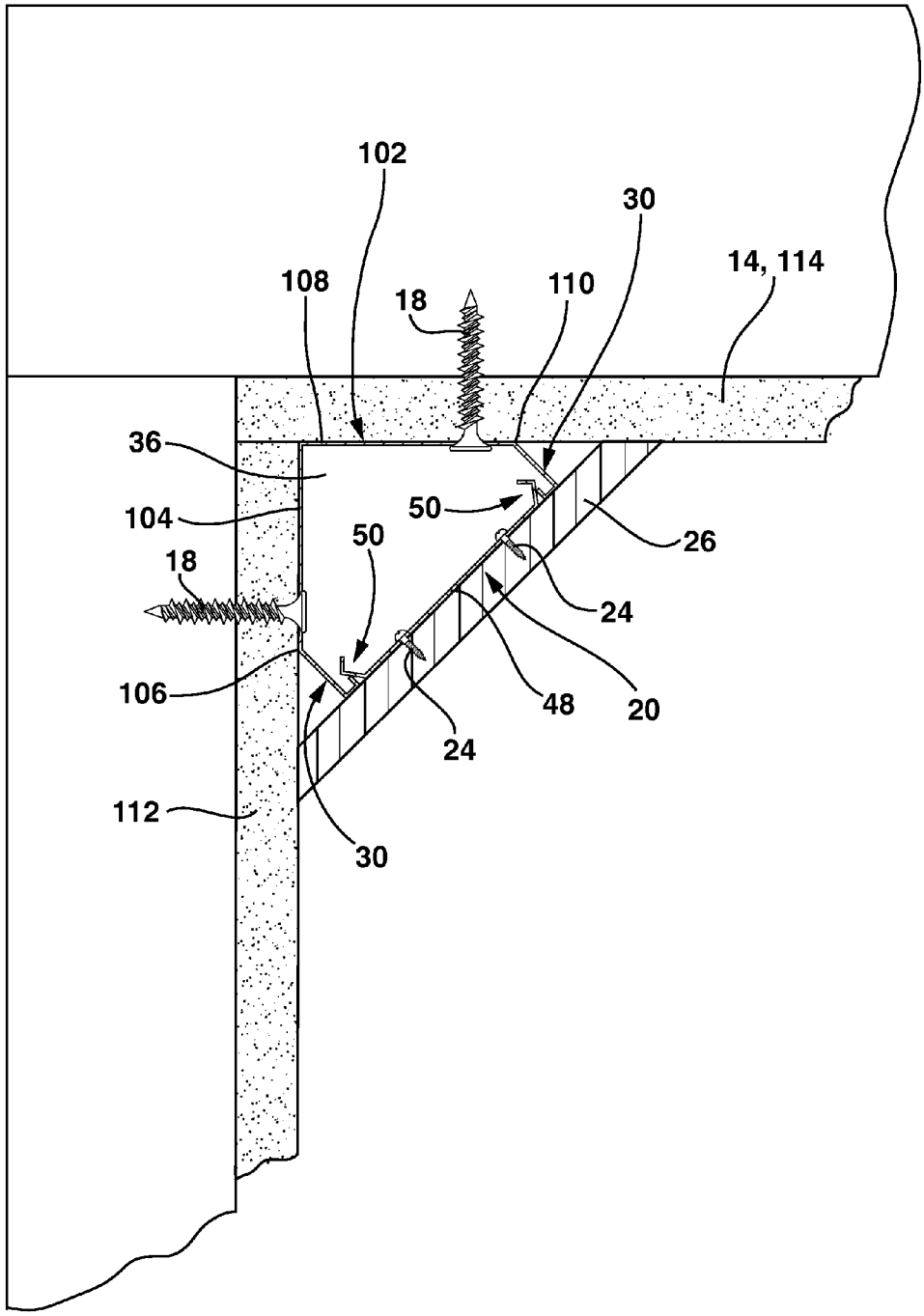
FIG. 10 is an end view of one embodiment of the bracket system of the present invention in place between a ceiling and a wall or between two walls.

The wall bracket retaining fingers 30 are located on opposite sides of the backplate 28 and extend away from the backplate 28 on the same side of the backplate 28. The wall bracket retaining fingers 30 each have a retaining fingers ultimate end 40 that curves inwardly toward each other forming a retaining finger lip 42. The height of the wall bracket retaining fingers 30 is such that a trim bracket 20 will be retained against the backplate 28 by contact between the wall bracket retaining fingers 30, and more particularly the lips 42, and the trim bracket 20 as will be described hereafter. In a particularly useful embodiment of the wall bracket 16, the wall bracket retaining fingers 30 have a height of slightly less than the thickness of a gypsum wall covering 44 or other wall covering material as shown in FIG. 9 so that when a trim bracket 20 is mated with the wall bracket 16, a piece of trim 22 attached to the trim bracket 20 will be moved into flush contact with the wall covering 44 and not held out from the finished wall surface by the wall bracket 16.

The length of a wall bracket 16 is defined as the distance parallel to the wall 12 or ceiling 14 that the bracket system 10 is attached to. For example, the length of a wall bracket 16 is represented by the horizontal length where the bracket system 10 is used to attach a piece of trim 22 to a wall 12. The length of the wall bracket 16 is preferably continuous between attachment points to the wall 12 or ceiling 14 with a length similar to the attaching trim 22.

Alternately, the length of the wall bracket 16 can be relatively shorter so that individual segments or clips are produced as described above that are placed at desired attachment points to the wall 12 or ceiling 14 spaced along the length of the attaching trim 22. As a further alternative, a combination of relatively long, continuous wall brackets 16 may be used in conjunction with one or more relatively short "clip" versions of the wall bracket 16. In any embodiment of the wall bracket 16, the length of the wall bracket 16 does not need to match the length of the attaching trim 22 as the wall bracket 16 or wall brackets 16 are concealed. Consequently, the length of the one of more pieces of wall bracket 16 only needs to be a length that provides an appropriate and desired attachment strength and stability to the attaching trim 22.

Although the backplate 28 in a preferred embodiment is essentially long, flat and planar, as described above the backplate 28 may also be short or made up of one or more shorter sections (FIG. 6). Further, the backplate 28 need not be flat. Instead, any shape may be used for the backplate 28 so long as the backplate 28 is capable of being rigidly attached to a wall through wall bracket fasteners 18. For example, the backplate 28 may be substantially planar but have a channel formed that extends along at least a portion of the backplate 28 to allow the backplate 28 to be placed over, for example, wiring or conduits. As mentioned above, portions of the backplate 28 may be removed to reduce the weight or cost of the material of the backplate 28. In addition, portions of the backplate 28 may be removed to allow air to circulate through or around the backplate 28. Further, backplate 28 may be curved in a vertical direction to allow the backplate 28 to be secured to a correspondingly shaped wall 12 or ceiling 14.

Figure 7:
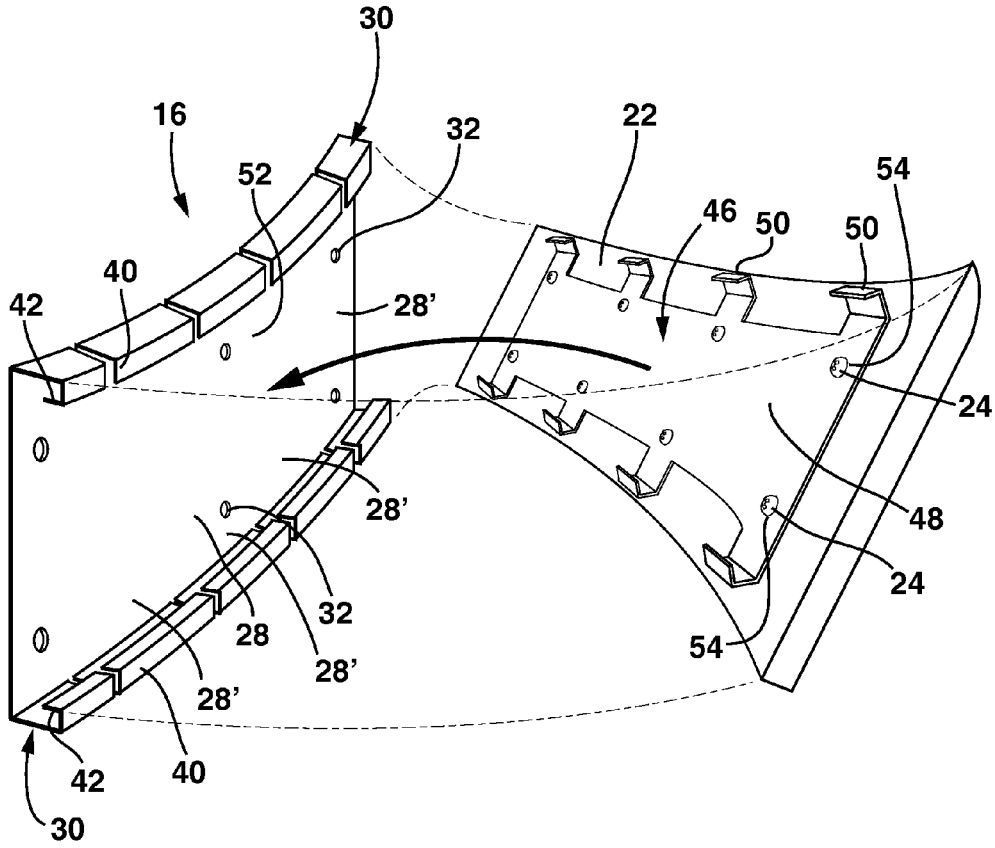
FIG. 7 is an end perspective view of a flexible embodiment of the wall bracket and the trim bracket as they move into mating and locking contact.

As can also be seen in FIGS. 2, 6 and 7, trim bracket 20 preferably includes at least one trim clip 46 each having a trim plate 48 and pair of opposed trim bracket retention edges 50 located on opposite edges of the trim plate 48. The preferred embodiment of the bracket system 10 includes the trim bracket 20 being made up of at least two individual trim clips 46 (FIG. 6). However, one embodiment of the bracket system 10 includes a single trim clip 46 where the trim plate 48 is essentially a long flat piece with a pair of opposed trim bracket retention edges 50 extending along edges of the trim plate 48 (FIG. 7). In another embodiment, the trim bracket 20 is a single trim clip 46 such as that shown in FIG. 6 with the trim clip 46 having a relatively short length. Whether there are several individual trim clips 46 or a single trim clip 46, the trim clip 46 or trim clips 46 are attached to a piece of trim 22 by trim bracket fasteners 24.

The trim plate 48 also preferably has at least one but preferably several trim plate holes 54 extending through the trim plate 48 to receive trim bracket fasteners 24 that pass through the trim plate holes 54 into the trim 22 to hold the trim bracket 20 in firm contact with the trim 22. The trim plate holes 54 can be vertically slotted type holes, if desired, that allow easy vertical adjustment of the trim 22 with respect to the trim bracket 20 without moving the existing trim bracket fasteners 24.

As mentioned above, the wall bracket 16 may be flexible or segmented to allow the wall bracket 16 to follow and conform to the shape of a curved wall 12 or ceiling 14 to which it is attached. The trim bracket 20 also needs to be flexible or segmented to mate with the wall bracket 16 where the wall bracket 16 is flexible or segmented and attached to a curved wall 12 or ceiling 14. The trim bracket 20 may itself be made of a flexible material (FIG. 7) or may be segmented (FIG. 8) to allow the trim bracket 20 to be flexible. In the embodiment of the trim bracket 20 shown in FIG. 7, the trim plate 48 is comprised of a single trim plate 48 made of a flexible material. Alternately, the trim plate 48 made be made of two or more trim clips 46 as shown in FIG. 6 or the trim plate 48 may be segmented (FIG. 8) similarly to how the backplate 28 is segmented into backplate segments 28' described above. Again, each trim plate segment 20' can be either rigid or flexible as desired and each trim plate segment 20' also has an associated trim clip 46 having a pair of opposed trim bracket retention edges 50 extending away from it as described herein. Each pair of opposed trim bracket retention edges 50 is sized to have a width corresponding roughly with the width of each trim plate segment. Of course, to use a curved or flexible wall bracket 16 and corresponding trim bracket 20, the trim 22 must also be curved or flexible. Similarly, as described in connection with the description of the backplate 28, it is also within the scope of the invention for a trim plate 48 to have material removed to make the trim plate 48 more flexible or to reduce the cost or weight of the material of the trim plate 48. Of course, a flexible or segmented wall bracket 16 could be used with a non-flexible or non-segmented trim bracket 20, or vice versa, when used on a flat wall 12 or ceiling 14.

The trim bracket retention edges 50 are located on opposite sides of the trim plate 48 of the trim clip 46 and extend away from the trim plate 48 in the same direction. The trim bracket retention edges 50 have a trim bracket most outer edge 56 and a trim bracket ultimate end 58 that curves inwardly forming a trim bracket lip 60. The height of the trim bracket retention edges 50 are such that, when coupled with the wall bracket retaining fingers 30 of the wall bracket 16, contact between the wall bracket retaining fingers 30 and the trim bracket retention edges 50 holds the trim bracket retention edges 50 in firm contact against the backplate 28 as shown in FIG. 9. As a result, the height of both the wall bracket 16 and trim bracket 20 are similar for the same bracket system 10 to allow for interlocking except that the height of the trim bracket 20 is slightly less than the height of the wall bracket 16 to allow the trim bracket 20 and attached trim 22 to be pulled against the face of the finished surface of the wall 12 or the wall bracket 16 and not held out from the finished surface of the wall 12 or wall bracket 16.

The maximum height of the wall bracket 16 and trim bracket 20 is determined by the height of the attaching trim 22 allowing adequate overlap of the trim 22 above or below the trim bracket 20 or both above and below the trim bracket 20 in order for the trim 22 to overlap and conceal the joint 62 between the wall bracket 16 and the adjacent finished surface of the wall 12. The minimum height of the wall bracket 16 and trim bracket 20 is determined by the height that provides adequate stability and support of the trim 22.

As described above, the trim bracket 20 may be made of a series of individual trim clips 46, one long continuous trim clip 46 or a combination of relatively shorter and longer trim clips 46. The length of a trim clip 46 can be continuous between attachment points to the trim 22 so that the trim clip 46 is similar in length to the attaching trim 22 or each trim bracket 46 can be a shorter individual segments placed at desired attachment points on the trim 22 spaced along the length of the attaching trim 22. The length of the entire trim bracket 20, whether as a continuous piece or a series of individual trim clips 46 does not need to match the length of the attaching trim 22 or wall bracket 16. This is because the one or more trim clips 46 are concealed and consequently only need to be a length that provides an appropriate and desired attachment strength and stability to the attaching trim 22.

The configuration of the retaining finger 30 and the retention edge 50 are such that both the retaining finger 30 and the retention edge 50 are able to flex as they move past initial contact with each other and to their final and locking position. This is preferably accomplished by the retention edge 50 having a configuration that allows the retention edge 50 to mate with the wall bracket retaining fingers 30 is a three step process shown in FIGS. 3-5.

Figure 3:
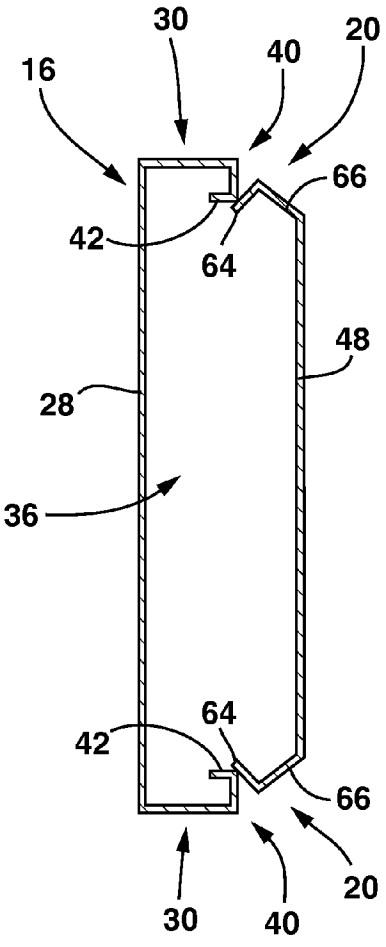
FIG. 3 is an end view of the first step in the mating process of the trim bracket with the wall bracket.

The first step in the three step process, shown in FIGS. 3, 6 and 7, brings the trim bracket retention edges 50 into contact with the wall bracket retaining fingers 30. In this configuration, the retention edge 50 near the trim bracket ultimate end 58 will be in contact with the wall bracket retaining fingers 30 near the retaining finger lip 42 but both the wall bracket retaining fingers 30 and the trim bracket retention edges 50 are in a rest or unstressed condition.

Figure 4:
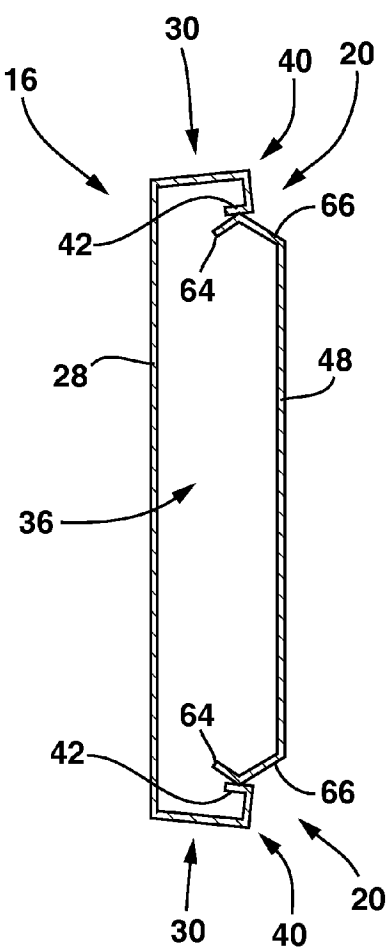
FIG. 4 is an end view of the second step in the mating process of the trim bracket with the wall bracket.

The second step in the three step process, shown in FIG. 4, moves the trim bracket 20 toward the wall bracket 16. As the trim bracket 20 is moved toward the wall bracket 16, the wall bracket retaining fingers 30 move slightly outwardly while the trim bracket retention edges 50 move slightly inwardly as the trim bracket most outer edge 56 moves past the retaining finger lip 42 thereby moving either the wall bracket retaining fingers 30 or the trim bracket retention edges 50 or both into a stressed or biased position. The wall bracket retaining fingers 30 and the trim bracket retention edges 50 are dimensioned to allow each to flex slightly as the trim bracket most outer edge 56 moves past the retaining finger lip 42 and then return to their rest position.

Figure 5:
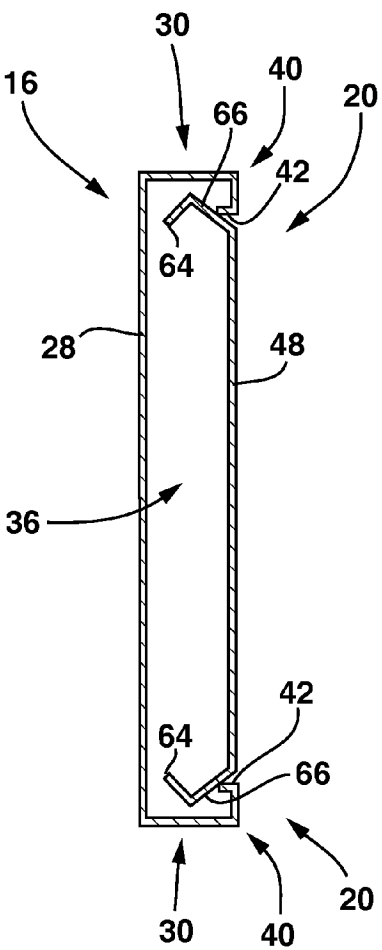
FIG. 5 is an end view of the third step in the mating process of the trim bracket with the wall bracket.

The third step in the three step process, shown in FIG. 5, is accomplished when the trim bracket most outer edge 56 has moved past the retaining finger lip 42. In this configuration, the trim bracket most outer edge 56 moves outwardly again while the wall bracket retaining fingers 30 move inwardly again so that the retention edge 50 is locked into place between the retaining finger lip 42 and the backplate 28 by contact between the retention edge 50, primarily around the trim bracket most outer edge 56, and the retaining finger 30 near the retaining finger lip 42.

Sometimes, instead of using the method to mate the wall bracket 16 to a trim bracket 20 as described above, it is easier to insert the bottom side of the trim clip 46 into the bottom side of the wall bracket 16 first and then push down on the trim 22 or trim bracket 20 while pushing the top side of the trim clip 46 into the top side of the wall bracket 16. This method of mating the wall bracket 16 and trim bracket 20 often seems easier because there is no need to flex both ends of both the wall bracket 16 and trim bracket 20 at the same time while mating. In some cases the method described and shown in FIGS. 3-5 will work better and in some cases the method just described will work better depending on the size of the pieces and the geometry or layout of the wall 12 or ceiling 14 that the bracket system 10 is used on.

As can be seen in FIGS. 2-5, the trim bracket retention edges 50 are shaped such that the trim bracket ultimate ends 58 and trim bracket most outer edges 56 of the trim bracket retention edges 50 are relatively far apart in their resting position and move farther closer to their respective partner trim bracket ultimate end 58 or trim bracket most outer edge 56 on the opposite side of the trim plate 48 as the trim bracket 20 is moved into mating contact with the wall bracket 16. Thereafter, the trim bracket ultimate ends 58 and most outer edges 56 of the trim bracket retention edges 50 move outwardly back to their rest position. In one embodiment of the trim bracket 20, this configuration of the trim bracket retention edges 50 is manifested in two different retention edge segments 64, 66 whereas in another embodiment of the trim bracket 20 this configuration is manifested in a single curved retention edge 50. It is possible to have trim bracket retention edges 50 having more than the two retention edge segments 64, 66 or a continuously curved retention edge 50 that is not semicircular in shape.

Further, as also can be seen in FIG. 2-5, the wall bracket retaining fingers 30 are shaped such that opposite retaining finger retaining finger ultimate ends 40 and retaining finger lips 42 are relatively close together in their resting position and move farther from their respective partner retaining finger ultimate end 40 or retaining finger lip 42 as the trim bracket 20 is moved into mating contact with the wall bracket 16. Thereafter, the retaining finger ultimate ends 40 and retaining finger lips 42 move back inwardly to their rest position. In one embodiment of the wall bracket 16, this configuration of the wall bracket retaining fingers 30 is manifested in three different retaining finger segments 68, 70 and 72. It is possible to have wall bracket retaining fingers 30 have two segments 68, 70 (FIG. 2) or a single curved retaining finger 30, semicircular or not, or a retaining finger 30 having a segment 68 with a curved retaining fingers ultimate end 40 that is semicircular or not in shape.

Further, the preferred embodiment described herein has both the wall bracket retaining fingers 30 and the trim bracket retention edges 50 flexing as the trim bracket 20 is moved toward and into locking contact with the wall bracket 16. However, in other embodiments of the bracket system 10, only the wall bracket retaining fingers 30 or the trim bracket retention edges 50, respectively, flex as the trim bracket 20 is moved toward and into locking contact with the wall bracket 16.

In use, the wall bracket 16 is attached to a wall 12 or ceiling 14 by the wall bracket fasteners 18 as shown in FIG. 9. A piece of trim 22 is attached to the trim bracket 20 by passing trim bracket fasteners 24 through the trim plate holes 54 so that the trim 22 is secured against the trim plate 32. In order to ensure that the trim 22 is precisely located against the trim bracket 20 and so that once the trim bracket 20 is placed and locked in mating contact with the wall bracket 16, the trim 22 will be precisely oriented against the wall 12 or ceiling 14, a template or jig may be placed against the trim 22 to place the trim bracket 20 in the desired location with respect to the trim 22. The template is preferably made of a thin material such as paper, cardboard, sheet aluminum or plastic and is either sized to indicate or has printed the location of the edges of the trim 22 and the location of the trim plate holes 54. The template is then placed over the trim 22 and the trim bracket fasteners 24 placed through the trim plate holes 54 into the trim 22 in the desired location on the trim 22. Where the trim bracket fasteners 24 are an adhesive, the template helps to precisely locate the trim plate 48 on the trim 22 so that the adhesive can take affect. A jig holds the trim bracket 20, trim 22 or both so that the trim bracket 20 is precisely located on the trim 22 by the trim bracket fasteners 24 in whatever form they may take.

Once a piece of trim 22 is securely attached to the trim bracket 20, the trim bracket 20 is brought into contact with the wall bracket 16 as described above in connection with step one of the three step connection process. The trim bracket retention edges 50 move in contact with the wall bracket retaining fingers 30 and past each other as described above in connection with step 1 until the trim bracket retention edges 50 move outwardly again and the wall bracket retaining fingers 30 move inwardly again so that the trim bracket 20 is held in its locked and retained position by the wall bracket retaining fingers 30 as shown in FIG. 9.

The configuration of the wall bracket retaining fingers 30 and the trim bracket retention edges 50 cooperate to securely hold the trim 22 in the desired location with respect to the wall 14 or ceiling 14. Also, this configuration causes the wall bracket 16 and trim bracket 20 to interlock with a self adjusting depth. This means that the interaction of the wall bracket retaining fingers 30 and trim bracket retention edges 50 in step three automatically pulls the trim 22 into contact with the wall 12 or ceiling 14.

It is also a part of the invention that the trim 22 be attached to the trim bracket 20 as described above and that the trim bracket 20 be mated with a wall bracket 16 but also where the trim 22 is not brought into contact with a wall 12 or ceiling 14. In this embodiment, the wall bracket 16 and trim bracket 20 interlock with a self adjusting depth as described above so that the interaction between the wall bracket retaining fingers 30 and trim bracket retention edges 50 in step three automatically pulls the trim bracket 20 into secure contact with the wall bracket 16 and the trim is attached to the trim bracket 20.

The bracket system 10 of the present invention is fully concealed by either being recessed from the face of a finished wall 12 or ceiling 14 or fully concealed behind the trim 22.

A preferred embodiment of the bracket system 10 includes a third bracket, an insert bracket 74 (FIG. 2). The insert bracket 74 is placed inside and concealed within the wall bracket 16 and either attached to a wall 12 or ceiling 14 with insert bracket fasteners 76 or placed inside the cavity 36 of the wall bracket 16 without direct attachment. If it is not directly attached to a wall 12 or ceiling 14, the insert bracket 74 can be shaped so that its form holds it within the wall bracket 16 until manually deformed or squeezed so that it can be removed.

The insert bracket 74 can be used in conjunction with the wall bracket 16 to help retain cabling within the wall bracket 16 when the trim bracket 20 is removed. As shown in FIG. 1, the insert bracket 74 can be placed inside the wall bracket 16 and attached to a wall 12 or ceiling 14 with insert bracket fasteners 76 or can be placed in the wall bracket 16 against the backplate 28 between the wall bracket retaining fingers 30 without direct attachment to the wall 12 or ceiling 14. In the latter embodiment, the insert bracket 74 is squeezed or deformed so that it passes between the fingers 30 and placed against the backplate 28. The trim bracket 20 holds the insert bracket 74 between the backplate 28 and the trim plate 48 of the trim bracket 20 when the wall bracket 16 and trim bracket 74 are mated together as described above.

The form or shape of the insert bracket 74 can vary depending upon the type of cabling that is desired to be placed and held within the wall bracket 16. However, the insert bracket 74 preferably includes a body 78 with a face plane 80, side edges 82 and insert bracket retaining edges 84 on each side of the insert bracket 74 extending away from the side edges 82. The body 78 is preferably an elongated body that spans substantially the entire length of its corresponding wall bracket 16. However, the body 78 can also be one or more clips so that the body 78 is relatively short in length. In either case, the body 78 in one embodiment includes insert bracket holes 86 for passing insert bracket fasteners 76 to anchor the body 78 to a wall 12 or ceiling 14. The insert bracket fasteners 76 may pass through the material of the backplate 28 or through backplate holes 32 in the backplate 28. The height of the insert bracket 74 is preferably about equal to the height of the side edges 82. This height is similar or less than the height of the wall bracket 16 that the insert bracket 74 is placed within.

In one embodiment, the insert bracket 74 is shaped to have one large groove 90 in the face plane 80 of the body 78 to hold cabling. In another embodiment the body 78 is shaped to have two or more small grooves 92 in face plane 80 of the body 78 to separate different cabling as may be desired if signal type cable and power type cable are run parallel and separation is required or desired to limit electrical interference or for any other reason. Either the large groove 90 or small grooves 92 may have the insert bracket holes 86 described above or the insert bracket holes 86 may be located at other locations along the body 78.

The height of the side edges 82 is less than the height of either the wall bracket 16 or trim bracket 20. This allows the trim bracket 20 to be placed over the insert bracket 74 and both the trim bracket 20 and insert bracket 74 moved past the retaining finger lip 42 so that interaction between the retaining finger lip 42 and the trim bracket retention edges 50 holds the trim bracket 20 and the insert bracket 74 securely in contact with the backplate 28 but keeps the insert bracket 74 from holding the trim bracket 20 away from the finished surface of the wall 12 or the wall bracket 16. In a preferred embodiment, the height of the side edges 82 is such that the face plane 80 is in contact with or near contact with the trim plate 48 when the trim bracket 20 and the insert bracket 74 are securely in contact with the backplate 28. The length of the one or more insert brackets 22 can be continuous along the length of the wall bracket 16 or can be one or more shorter individual segments placed at desired spacings along the wall bracket 16.

As mentioned above, the insert bracket 74 has insert bracket retaining edges 84. In a preferred embodiment of the insert bracket 74, the width of the face plane 80 is such that the face plane 80 will pass between the lips 42 of the wall bracket retaining fingers 30. In this embodiment, the insert bracket retaining edges 84 extend from the side edges 82 a distance approximately the distance that the retaining finger lip 42 extends inwardly from the wall bracket retaining fingers 30 so that the distance from one edge of a insert bracket retaining edge 84 to the other insert bracket retaining edge 84 is about the distance between the inside surfaces of the wall bracket retaining fingers 30 between the backplate 28 and the lips 42. This allows the insert bracket 74 to be moved past the lips 42 by squeezing or deforming the insert bracket 74 and then return to its rest configuration to be retained between the wall bracket retaining fingers 30 by frictional forces until either the insert bracket 74 is secured against a wall 12 or ceiling 14 by insert bracket fasteners 76 or until the trim bracket 20 is "snapped" into secure and locking contact with the wall bracket 16 as described above.

In a different embodiment of the insert bracket 74 shown in FIG. 2, the insert bracket retaining edges 84 may also be formed in the mirror image shape of the trim bracket retention edges 50 described above. In this embodiment, the insert bracket retaining edges 84 are moved past the retaining finger lip 42 of the wall bracket retaining fingers 30 and prevented from moving away from the wall bracket 16 by the interaction between the insert bracket retaining edges 84 and the wall bracket retaining fingers 30. In this embodiment, the insert bracket retaining edges 84 include a insert bracket retaining finger 94 having an insert bracket ultimate end 96 and a insert bracket most outer edge 98. The insert bracket retaining finger 94 extends away from the insert bracket outer edge 100 in the direction of the face plane 80 so that the insert bracket ultimate end 96 is displaced from the retention edge 84. The insert bracket most outer edge 98 is on the outside of the insert bracket retaining finger 94 so that opposed insert bracket most outer edges 98 are slightly farther apart in their resting configuration than are the insert bracket outer edge 100 or the other parts of the sides of the insert bracket retaining finger 94.

In this embodiment of the insert bracket 74, the insert bracket 74 is moved into contact with the wall bracket retaining fingers 30. Contact between the insert bracket retaining finger 94 and the retaining finger 30 causes the insert bracket retaining finger 94 to initially move inwardly and the retaining finger 30 to move outwardly until the insert bracket most outer edge 98 moves past the retaining finger lip 42. At this point, further movement of the insert bracket 74 towards the backplate 28 causes the insert bracket retaining finger 94 to move outwardly and the retaining finger 30 to move inwardly to retain the insert bracket 74 between the retaining finger lip 42 and the backplate 28.

The insert bracket 74 is concealed within the wall bracket 16 and can be placed inside the wall bracket 16 and either attached to the wall bracket 16 or the wall 12 or ceiling 14 with insert bracket fasteners 76 or adhesive or can be placed inside the cavity 36 of the wall bracket 16 without direct attachment. If it is not directly attached to the wall bracket 16, the insert bracket 74 can be shaped so that its form holds it within the wall bracket 16 until manually deformed or squeezed so that it can be removed my moving it between the lips 42.

Another embodiment of the bracket system 10 is shown in FIGS. 1, 10, 11 and 12 that allows trim 22 to be placed between two adjoining walls 12 or between a wall 12 and a ceiling 14 (as for example, trim in the form of crown molding 26). In one embodiment shown in FIG. 10, the bracket system 10 includes a corner bracket 102 having a first wall piece 104 with a first wall piece ultimate end 106 and a second wall piece 108 with a second wall piece ultimate end 110. Since most walls 12 or a wall and a ceiling 14 meet at a ninety degree angle, the first wall piece 104 and second wall piece 108 preferably meet at a ninety degree angle. But, where the corner bracket 102 is to be used between walls 12 or a wall 12 and a ceiling 14 that meet at angles other than ninety degrees, the angle between the first wall piece 104 and second wall piece 108 may be at an angle other than ninety degrees. Regardless of the angle between the first wall piece 104 and second wall piece 108, it is preferred that the first wall piece 104 be flush against a first wall 112 and the second wall piece 108 be flush against a second wall 114. The first wall piece 104 and the second wall piece 108 also preferably do not have backplate holes 32 extending through respective first wall pieces 104 and the second wall pieces 108 to attach the first wall piece 104 to a first wall 112 and the second wall piece 108 to a second wall 114 but may have backplate holes 32 if desired.

In a preferred embodiment of the corner bracket 102, the first wall piece 104 and the second wall piece 108 both have a retaining finger 30 extending from their respective ultimate ends 106, 110. Regardless of the angle between the first wall piece 104 and the second wall piece 108, the wall bracket retaining fingers 30 are preferably parallel to each other and have retaining finger ultimate ends 40 and lips 42 as described above. A cavity 36 is formed between the first wall piece 104 with its corresponding retaining finger 30 and the second wall piece 108 with its corresponding retaining finger 30.

The bracket system 10 that includes a corner bracket 102 also includes a trim bracket 20 as described above. In use, the trim bracket 20 is attached to the corner bracket 102 through a three step process similar to the process for connecting a trim bracket 20 to a wall bracket 16 described above. Here, the trim bracket 20 is brought into contact with the corner bracket 102 so that the trim bracket retention edges 50 move into contact with the wall bracket retaining fingers 30. In this configuration, the retention edge 50 near the retaining fingers ultimate end 40 will be in contact with the wall bracket retaining fingers 30 near the trim bracket lip 60 but both the wall bracket retaining fingers 30 and the trim bracket retention edges 50 are in a rest or unstressed condition.

In the second step, the trim bracket 20 moves toward the corner bracket 102. As the trim bracket 20 is moved toward the corner bracket 102, the wall bracket retaining fingers 30 move slightly outwardly while the trim bracket retention edges 50 move slightly inwardly as the trim bracket most outer edge 56 moves past the retaining finger lip 42. The wall bracket retaining fingers 30 and the trim bracket retention edges 50 are dimensioned to allow each to flex slightly as the trim bracket most outer edge 56 moves past the retaining finger lip 42 and then return to their rest position.

Finally, when the trim bracket most outer edge 56 has moved past the retaining finger lip 42, the trim bracket most outer edge 56 moves outwardly again while the wall bracket retaining fingers 30 move inwardly again so that the retention edge 50 is locked into place by contact between the retention edge 50 primarily around the trim bracket most outer edge 56 and the retaining finger 30 near the retaining finger lip 42.

Figure 11:
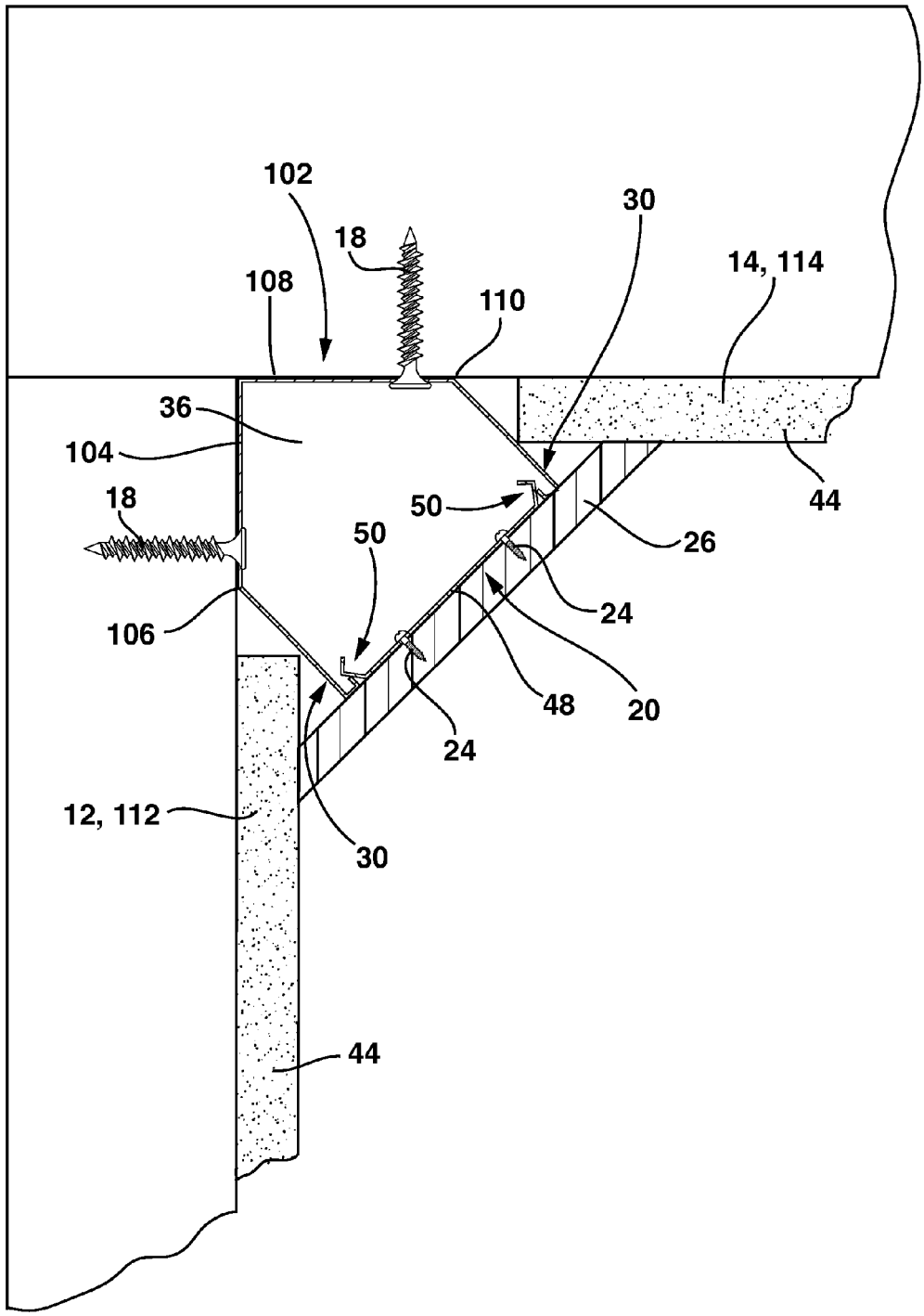
FIG. 11 is an end view of another embodiment of the bracket system of the present invention in place between a ceiling and a wall or between two walls.

In another embodiment shown in FIG. 11, the corner bracket 102 is again attached in the corner between two walls 12 or between a wall and a ceiling 14. However, the corner bracket 102 in this embodiment is attached directly to the studs, wood paneling or any other type of wall construction material of the walls 12 or ceiling 14, respectively where a wall covering 44 is attached to and covers the studs, wood paneling or other type of wall construction material. In this embodiment, the wall covering 44 does not extend entirely to the corner. As depicted in FIG. 11, the wall covering 44 that is in contact with the piece of crown molding 26 could also be pieces of trim 22 instead of or in addition to standard gypsum wall board.

In this embodiment, it may be desirable but not necessary for the length of the first wall piece 104 and second wall piece 108 or wall bracket retaining fingers 30, or both the first wall piece 104 and second wall piece 108 and wall bracket retaining fingers 30 be somewhat longer than in the previous embodiment to accommodate for the absence of a wall covering 44 behind the wall bracket. Because this embodiment potentially has longer first wall piece 104, second wall piece 108 and wall bracket retaining fingers 30, this embodiment may also provide the advantage of more easily passing cable between the wall cavity and ceiling cavity.

When the corner bracket 102 is attached to the studs, wood paneling or other type of wall construction material, the trim 22 is also attached to a trim bracket 20 that is attached to the wall bracket 16 as described above. The trim 22 in this case typically is a crown molding 26. The wall bracket 16 and the trim bracket 20 are then mated as described above thereby moving the crown molding 26 into contact with the wall covering 44 of the wall 12 and ceiling 14 or wall 12 and another wall 12 as shown in FIG. 11.

Figure 12:
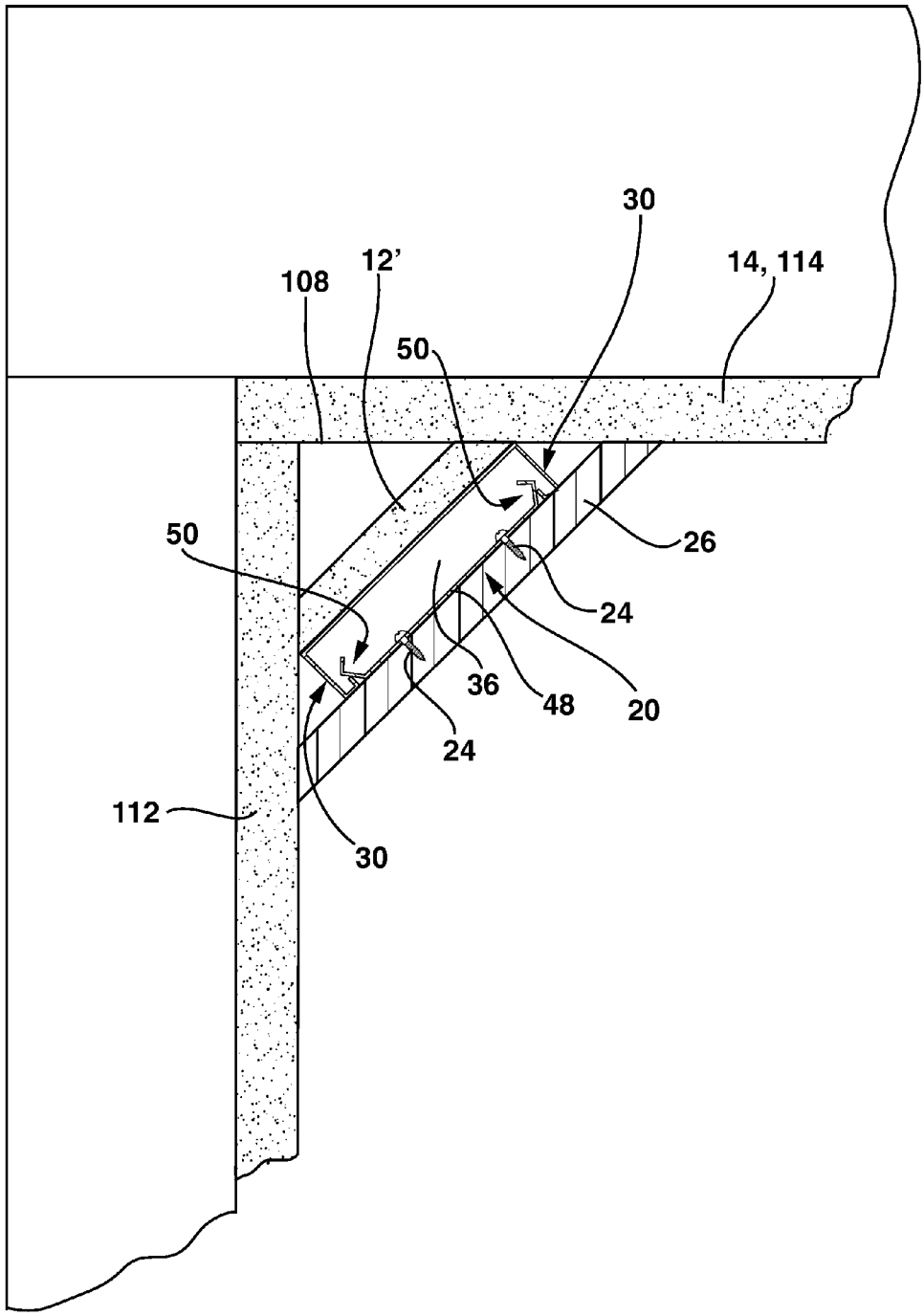
FIG. 12 is an end view of another embodiment of the bracket system of the present invention in place between a ceiling and a wall or between two walls.

In another embodiment shown in FIG. 12, a structural wall 12' extends between the wall 12 and the ceiling 14 or between two walls 12. In this embodiment, the wall bracket 16 is attached directly to the structural wall 12' and the crown molding 26 is attached to the trim bracket 20 as described above. The wall bracket 16 and the trim bracket 20 are then mated as described above thereby moving the crown molding 26 into contact with the wall 12 and ceiling 14 or wall 12 and another wall 12.

The corner bracket 102 may also use the insert bracket 74 described above. The insert bracket 74 may be as described above where the insert bracket retaining edges 84 span between the connection of the first wall piece 104 and it corresponding retaining finger 30 and the second wall piece 108 and its corresponding retaining finger 30. Alternately, the insert bracket 74 may be of the type where insert bracket retaining fingers 94 extend from the insert bracket retaining edges 84 and are "locked" into place by interaction between the insert bracket retaining fingers 94 and the retaining finger lip 42 of the wall bracket retaining fingers 30. In a further alternate embodiment of the insert bracket 74, the respective insert bracket retaining fingers 94 are formed to be conformal with the respective first wall piece 104 and second wall piece 108.

The wall bracket 16, trim bracket 20 and insert bracket 74 are each preferably formed in one piece from a rigid durable material such as bent or punched sheet metal, cast metal or molded or extruded plastic, fiberglass, composite material or ceramic. Alternately, the wall bracket 16, trim bracket 20 and insert bracket 74 are formed from several pieces from the same or different materials. The strength and rigidity of the material of the wall bracket 16, trim bracket 20, corner bracket 102 and insert bracket 74 can vary depending upon the sizes of the respective pieces and the desired strength of their interconnections.

Where the wall bracket 16, trim bracket 20 and insert bracket 74 are made of a material (e.g., sheet steel), these elements may be easily cut or trimmed as needed with conventional hand tools (e.g., tin snips) or power tools (e.g., cut-off saw). This allows the length of standard wall brackets 16, trim brackets 20 or insert brackets 74 to be easily modified to required lengths prior to installation or coped for passage of cabling, etc. in and out of the bracket system 10 without compromising its effectiveness.

Where multiple segments of wall bracket 16, trim bracket 20 or insert bracket 74 are used, the number of such brackets used will vary depending upon the appropriate and desired attachment strength or stability of the attaching trim 22 and the corresponding height and length of the attaching trim 22 compared with the height and length of the brackets used. Also, for larger pieces of trim 22, it may be desired to have parallel tracks of wall brackets 16 each having its corresponding trim bracket 20 or insert bracket 74. For standard heights of trim 22, one row of wall brackets 16 may most preferably be used. However, if the height of the trim 22 greatly exceeds the width of the trim bracket 20, multiple rows of wall brackets 16 and trim brackets 20 may be used to securely attached the trim 22 against the wall 12 or ceiling 14.

In a variant of the invention, the bracket system 10 may be adapted to locate and securely hold a modular wall with respect to flooring 134, other wall 12 or ceiling 14. Consequently, another embodiment of the invention is a system of modular walls. In this system, one or more wall brackets 16 are attached to a movable wall 12. One or more corresponding trim brackets 20 are attached to flooring 134, other wall 12 or ceiling 14. The movable wall 12 is moved into position so that the wall bracket 16 on the movable wall 12 mates with the trim bracket 20 on the flooring 134, other wall 12 or ceiling 14.

Figure 16:
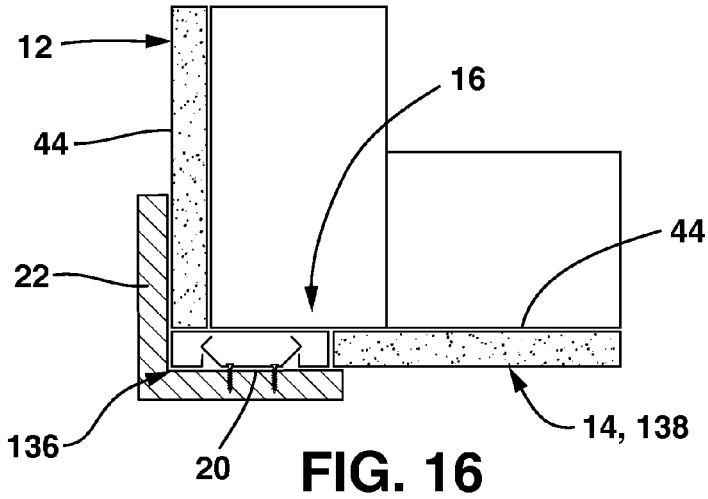
FIG. 16 is an end view of an embodiment of the bracket system of the present invention in use as trim around a corner.
Figure 17:
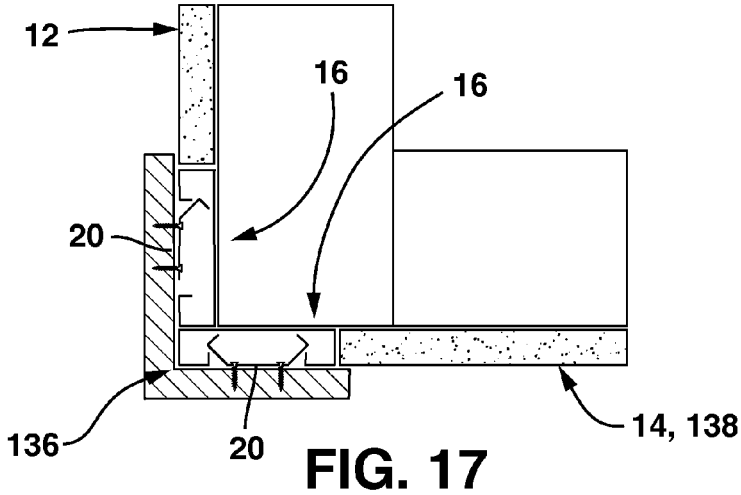
FIG. 17 is an end view of another embodiment of the bracket system of the present invention in use as trim around a corner.
Figure 18:
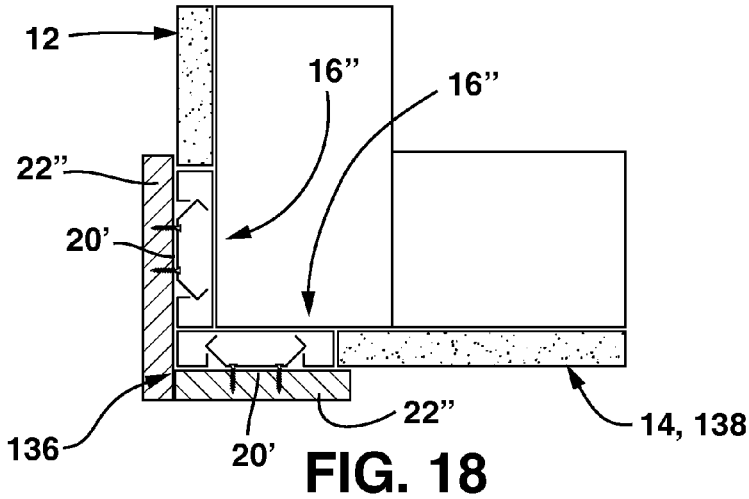
FIG. 18 is an end view of another embodiment of the bracket system of the present invention in use as trim around a corner.

Another embodiment of the bracket system 10 is shown in FIGS. 16-18 where the bracket system 10 is located on the outside corner 136 of a wall 12 to second wall 114 configuration or between a wall 12 and a recessed ceiling joist 138. The trim 22 in all of the following three described embodiments helps protect the outside corner 136 of the wall 12 to second wall 114 or wall 12 to recessed ceiling joist 138 configuration from damage or eliminates the labor of installing, taping or mudding a corner bead on drywall or both.

As shown in FIG. 16, a single wall bracket 16 is attached to either a wall 12 or second wall 114 or recessed ceiling joist 138 near a corner 136. The wall bracket 16 may be attached directly to the wall 12, second wall 114 or recessed ceiling joist 138 so that the wall bracket 16 is recessed from or flush with the face of the wall covering 44 of the finished wall 12, second wall 114 or recessed ceiling joist 138 or may project from the face of the wall 12, second wall 114 or recessed ceiling joist 138 including being attached over the wall covering 44.

The trim 22 in this embodiment is a 90° piece that is attached to a trim bracket 20 that is in turn connected to the wall bracket 16 as described above. Although the preferred embodiment of this embodiment has the trim 22 being a 90° piece corresponding to the 90° configuration of the outside of the corner 136, where the corner 136 is at an angle other than 90°, the corresponding trim 22 would have an angle corresponding to the angle of the corner 136 whatever it is.

Another variant of this embodiment is shown in FIG. 17 where two wall brackets 16' and 16" are attached to a respective wall 12 and second wall 114 or recessed ceiling joist 138 on each side of the corner 136. Two trim brackets 20' and 20" are attached to a piece of trim 22 that is also a single 90° piece. The trim brackets 20' and 20" are brought into contact with their respective wall brackets 16' and 16" to connect the trim 22 around the corner 136 as described above. It may be necessary for one of the trim bracket retention edges 50 of one or more of the trim brackets 20', 20" to be trimmed or cut off (FIG. 17) in order to install or remove the trim 22.

Again, although the preferred embodiment of this embodiment has the trim 22 being a 90° piece corresponding to the 90° configuration of the corner 136, where the corner 136 is at an angle other than 90°, the corresponding trim 22 would have an angle corresponding to angle of the corner 136 whatever it is. Using two pairs of wall brackets 161 and 16" and trim brackets 20' and 20" will likely provide a more secure connection of the trim 22 to the respective walls 12 and second wall 114 or recessed ceiling joist 138 than the previous embodiment with only a single pair of wall bracket 16 and trim bracket 20.

A further variant of this embodiment is shown in FIG. 18 where two wall brackets 16', 16" are attached to a respective wall 12 and second wall 114 or recessed ceiling joist 138 on each side of the corner 136. However, in this embodiment, two trim brackets 20', 20" are each attached to a respective piece of trim 22', 22" which two pieces of trim 22', 22", when in place through the interaction of the wall brackets 16 and trim brackets 20', 20", interact to form a 90° cover around a corner 136. In this embodiment, the trim bracket 20' attached to the trim 22' that will be covered in part by the other piece of trim 22" is first brought into contact with its respective wall bracket 16' to connect this piece of trim 22' next to the corner 136 as described above. Then, the trim bracket 20" corresponding to the trim 22" covering the piece of trim 22' is brought into contact with its respective wall bracket 16" to connect this piece of trim 22" next to the corner 136 on the opposite side of the corner 136 as described above so that the piece of trim 22" covers the portion of the second wall 114 or recessed ceiling joist 138 and, in part, the piece of trim 20'.

Again, the preferred embodiment of this embodiment has the two pieces of trim 22' and 22" forming a 90° cover of the corner 136 corresponding to the 90° configuration of the corner 136. But, where the corner 136 is at an angle other than 90°, the corresponding pieces of trim 22' and 22" would have an angle corresponding to the angle of the corner 136 whatever it is. Further, although the configuration of the two pieces of trim 22' and 22" described above have been an overlapping joint, it is also within the scope of the invention that the two pieces of trim 22' and 20" meet with their mating edges meeting at 45° or half the angle of the angle formed by the corner 136 if such angle is other than 90°.

In view of the foregoing, a method for installing modular walls is also part of the invention. In this method, a movable wall 12 is provided and one or more wall brackets 16 are attached to the movable wall 12. One of more corresponding trim brackets 20 are attached to flooring 134, other wall 12 or ceiling 14. The movable wall 12 is moved into position so that the wall bracket 16 on the movable wall 12 mates with the trim bracket 20 on the flooring 134, other wall 12 or ceiling 14. In this embodiment, the wall bracket 16 has been attached to the wall 12 and the trim bracket 20 attached to the flooring 134, other wall 12 or ceiling 14. However, in a variant of this embodiment, the trim bracket 20 is attached to wall 12 and the wall bracket 16 is attached to the flooring 134, other wall 12 or ceiling 14.

As described above, trim 22 is attached to the wall bracket 16. This trim 22 is conventional finish carpentry trim of any type of readily available wood, vinyl or other trim used in residential, commercial or industrial construction. Trim 22 can be of various shapes and sizes and be used for conventional trim carpentry including, but not limited to, base board trim 116, chair rail trim 118, crown molding 26 or door trim 120, window trim 122, plinths 124 and corner pieces 126.

Figure 13:
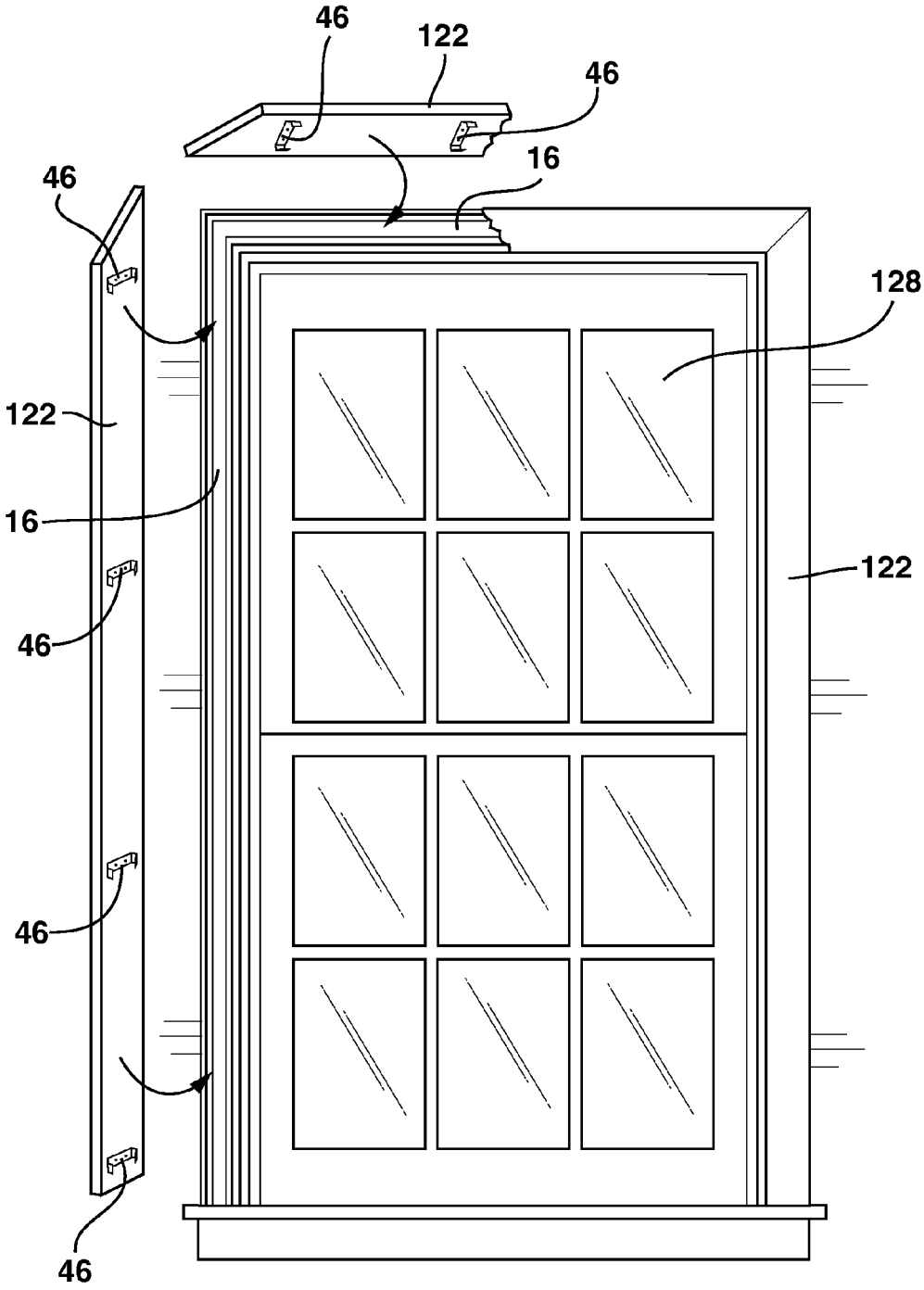
FIG. 13 is a front view of the bracket system of the present invention in use as trim around a window.
Figure 14:
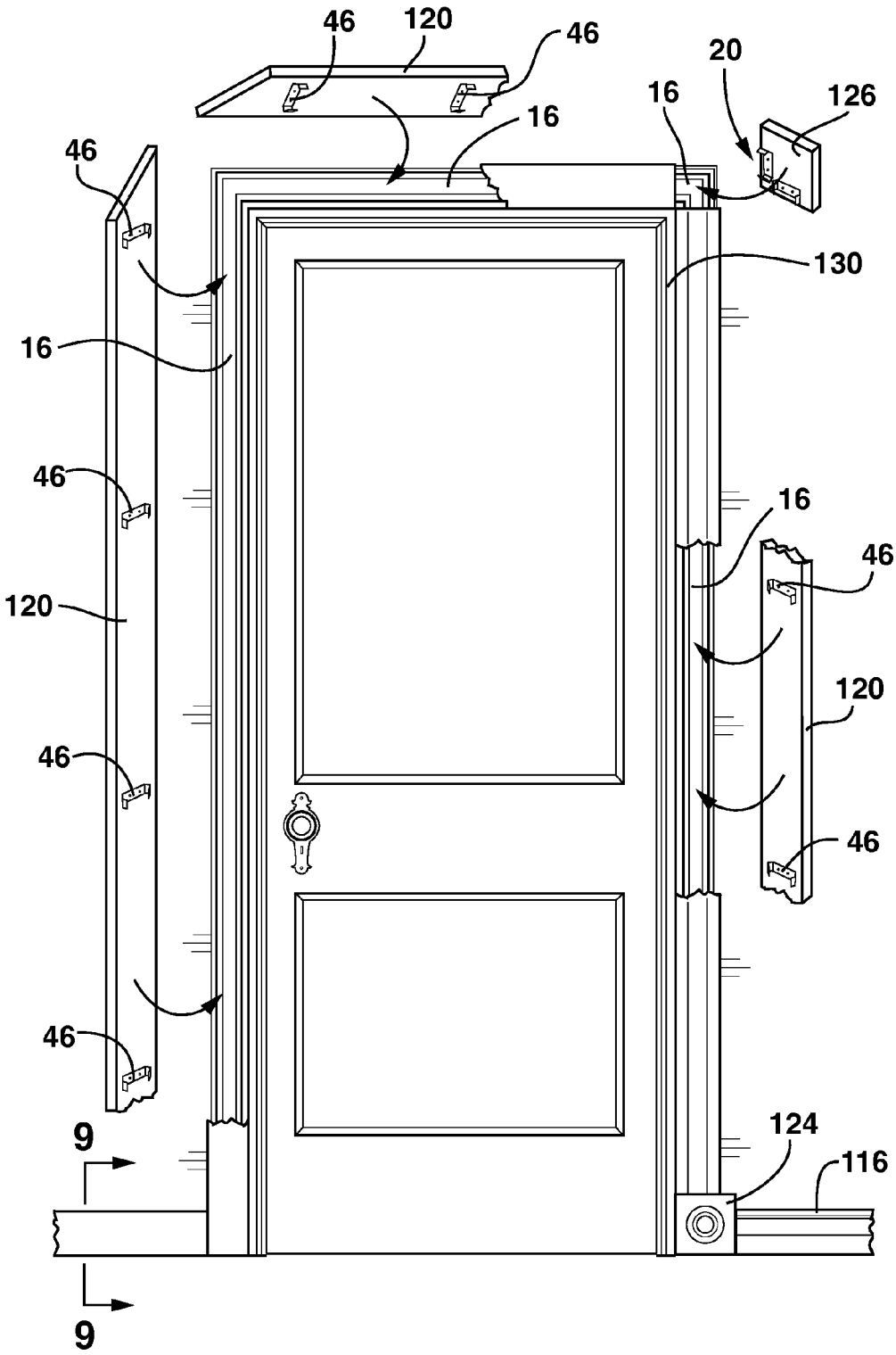
FIG. 14 is a front view of the bracket system of the present invention in use as trim around a door.
Figure 15:
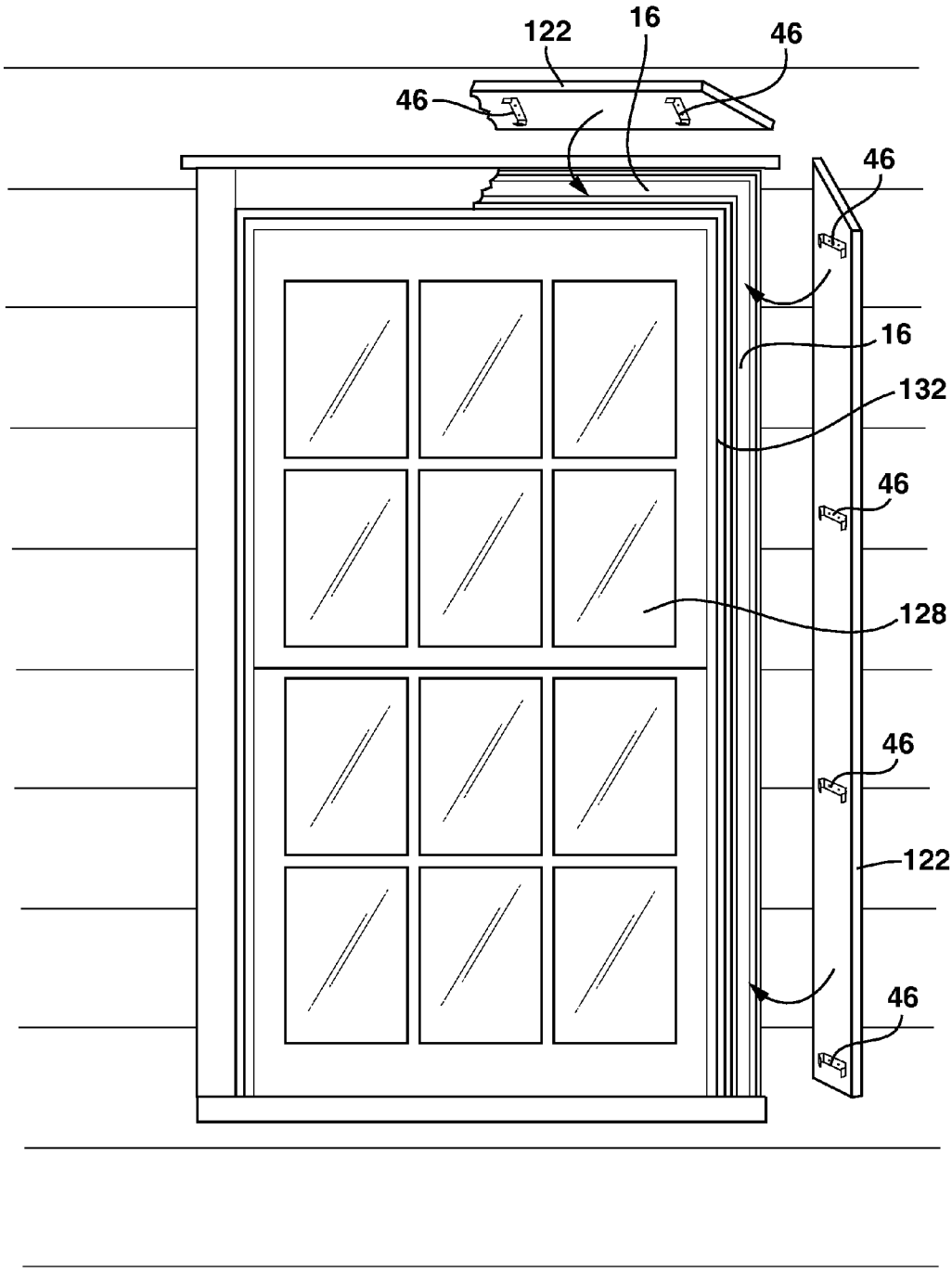
FIG. 15 is a front view of the bracket system of the present invention in use as trim inside the frame of a window.

Throughout this description, the trim 22 has been described as being primarily attached to a wall 12 or ceiling 14. The trim 22 may also be placed against an inside or outside wall 12, framing an inside or outside window 128 (FIG. 13), around an inside or outside door frame 130 (FIG. 14) or around the inside of a window frame 132 inside or on the outside of a house (FIG. 15). As mentioned, the trim 22 may also be attached to the trim bracket 20 so that the trim 22 is not in contact with a wall 12 or a ceiling 14 but is instead positioned by the interconnection of the trim bracket 20 with the wall bracket 16 wherever the wall bracket 16 is located.

Throughout this description the "fasteners" 18, 24 and 76 have been used to describe connection between various parts of the bracket system 10 and the wall 12, ceiling 14 or trim 22. "Fasteners" 18, 24 and 76 means any means for attaching these respective parts including, but not limited to, screws, nails, rivets and adhesives. The adhesive may be construction type adhesive, glues or any other product suitable for connection of the respective piece to a wall 12, ceiling 14 or piece of trim 22.

There are many objects of the present invention in its various embodiments that may be addressed individually or in combinations and permutations. Consequently, each embodiment described herein may address one or several of the following objectives or benefits:

1. Trim 22 can be easily removed for coating or painting the finished surfaces of the wall 12 or ceiling 14 or installing wall coverings 44 for the wall 12 or ceiling 14 without working around or masking the trim 22.

2. Trim 22 can be easily removed for coating or painting or refinishing of the trim 22 itself without consideration of interference with the surfaces of the wall 12 or ceiling 14.

3. Base board trim 116 can be easily removed and the wall bracket 16 raised or lowered in order to raise or lower the base board trim 116 to accommodate installation of a new higher or lower flooring 134 such as new wood or ceramic flooring therefore eliminating the need to remove and renail the base board trim 116 or to install additional trim 22 to cover the outside edge of the new flooring.

4. No nail holes are required on the face of the trim 22 that need to be puttied or are visible.

5. Typically in home or building construction, wall covering 44 such as gypsum board is attached to a wall 12 first and a sub-floor flooring 134 or flooring 134 or both added later. As a result, a gap is formed between the wall 12 and the flooring 134. The bottom of the trim bracket 20 and the trim 22 itself can be used to cover up this gap while still allowing expansion or contraction of the gap between the wall 12 and the flooring 134. The additional width provided by the trim bracket 20 allows more room to cover up the gap than traditional construction methods. This additional room allows elimination of additional base shoe type molding (e.g., quarter round molding) to be added to the main base board trim 116.

6. The wall bracket 16 and trim bracket 20 can be used with commercially available conventional trim 22.

7. Trim 22 can be easily removed and reinstalled repeatedly without any change in appearance that may result from repeatedly nailing in place.

8. The bracket system 10 requires less coordination in timing of different construction trade's work during construction since trim 22 can be cut and fit prior to installation of the finished surface of the wall 12 or ceiling 14.

Figure 8:
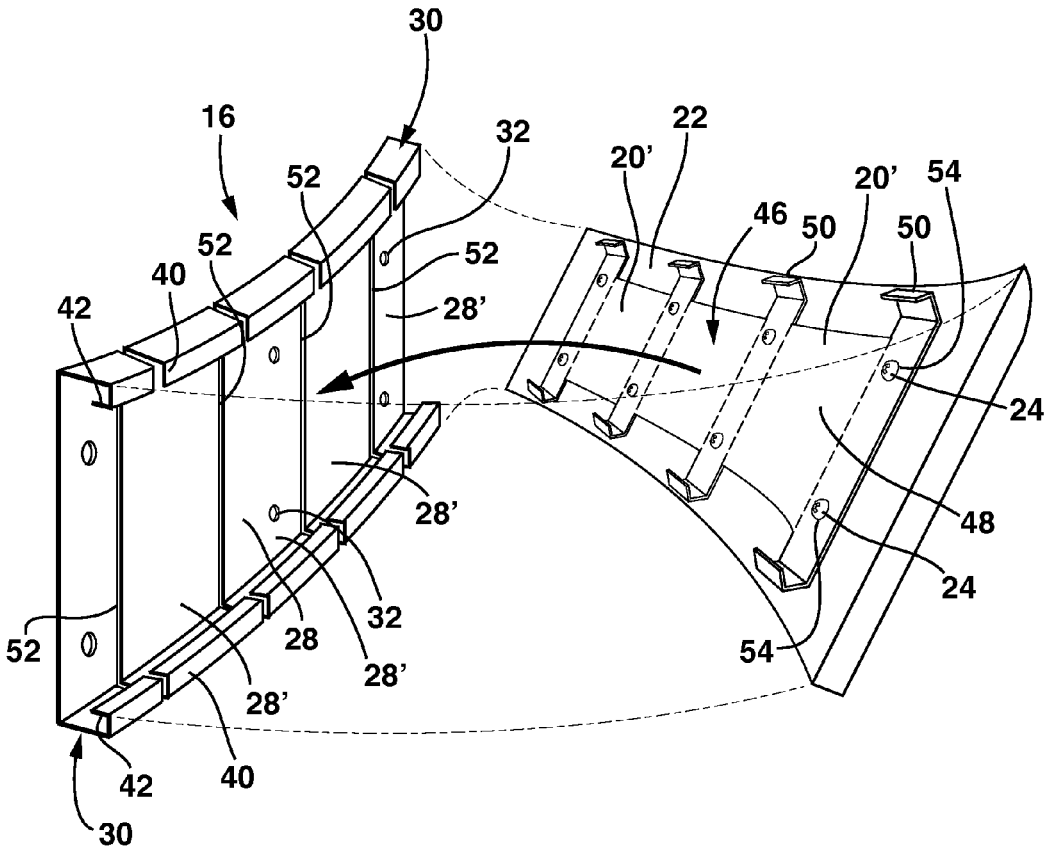
FIG. 8 is an end perspective view of a segmented embodiment of the wall bracket and the trim bracket as they move into mating and locking contact.

9. The height taken up by the wall bracket 16 allows standard dimensional wall covering 44, such as gypsum board, to be raised to allow higher walls 12 without the need for additional seams in the wall coverings 44 because the wall bracket 16 itself raises the bottom edge of a wall cover by the width of the wall bracket 16 when the wall bracket 16 is used next to a floor as shown in FIG. 8 or between wall covering 44 when the wall bracket 16 is located higher up on a wall 12.

10. A gap (cavity 36) can be created between the wall bracket 16 and the trim bracket 20 that can be used as a conduit for items such as a power cable, speaker wire, coaxial cable, telephone wire, security wire or similar wires or cabling.

11. Any cabling run between the wall bracket 16 and the trim bracket 20 can be easily accessed without damage to the wall 12 or ceiling 14. This allows easy installation of new cabling after final wall construction.

12. Any cabling can pass in or out of the wall bracket 16 to pass cabling in or out of the wall cavity 34 or ceiling cavity 38 without visible damage to the wall covering 44 of the wall 12 or ceiling 14. For example, for installing a new wall mounted speaker in an existing structure, a new mounting box could be cut into the wall 12, a hole in the wall bracket 16 could be cut below the mounting box and speaker cable could be fished through the wall cavity 34 down to the hole in the wall bracket 16 and then routed through the trim bracket 20 cavity to the stereo location without any need for patching of the finished wall 12.

13. Any cabling can pass in or out of the bottom of the trim bracket 20 to route underneath the trim 22 and into a room without damage to the finished wall covering 44. For example, speaker cable can be run underneath the trim 22 and into the trim bracket 20 cavity from one side of a room where the receiver/amplifier is placed to another side of a room where it is then passed out of the trim bracket 20 cavity to where the speaker is placed with minimal speaker cable visible from inside the room. This speaker wiring can easily be installed after the wall 12 and trim 22 are installed and can easily be changed or removed at any time.

14. For remodeling an existing structure, the existing trim 22 can be removed and then the portion of the wall covering 44 that will be replaced by the wall bracket 16 can be removed allowing access to the wall cavity 34. Such access to the wall cavity 34 can accommodate installation of new cabling, water piping, insulation or similar items without the need for extensive removal and reinstallation of the wall covering 44. A wall bracket 16 can then be placed where the wall covering 44 was removed, the existing nails can be cut off the existing trim 22, a trim bracket 20 can be attached to the existing trim 22, and then the trim 22 can be reinstalled back on the wall 20 without the need for any restoration work to the wall 20.

15. Money is saved by eliminating the need to mask existing trim 22 when initially painting or repainting walls 12 or ceilings 14.

16. Removal of the trim 22 during repainting keeps a clean appearance at the joint 62 between the wall 12 and trim 22 and keeps it looking new.

17. The corner bracket 102 provides a flat surface for easy installation of crown molding 26 or other similar trim 22 that does not mount flush with a single surface and that often requires shimming or other bracing to assist in attachment of the trim 22.

18. Typical current residential window construction includes an integral flange with the window that is attached to the outside of a house and then covered up with siding and molding. Removal or replacement of the window requires removal and replacement of the siding that covers the flange. If window construction utilized a flange that mounted to the interior of the building and had the configuration of a wall bracket 16, the use of trim brackets 20 would allow easy access to the window flange and therefore allow easy removal or replacement of windows.

19. For modular type removable walls 12 that are fixed at the top and at the bottom, the use one or more wall brackets 16 at the point of attachment and corresponding trim brackets 20 on the removable wall 12, or vice versa, would allow easy access to points of attachment of trim 22 and therefore would allow easy removal and moving of a wall 12 without requiring destruction of any portions of the wall 12. In addition, the use of wall brackets 16 on the wall 12 with trim brackets 20 as described above would accommodate finished permanent looking wall construction with typical conventional trim 22.

20. Modular walls 12 are readily positioned and securely fastened into place. When it is desired to move the wall 12, the wall 12 is "snapped" from its anchor thereby separating the wall 12 from flooring 134, another wall 12 or a ceiling 14.

21. Trim 22 can be easily removed during removal and installation of carpeting or other flooring products so that the trim 22 does not get scratched or damaged.

22. Trim 22 and trim brackets 20 can be removed to allow easy installation of blown in insulation through holes in the wall brackets 16 for new and existing construction eliminating the need to insulate prior to installation of the wall coverings 44.

23. Short lengths of conduit could be installed from boxes (i.e. electrical outlet boxes) to the wall bracket 16 that would allow for installation, removal and replacement of cabling after final wall construction is completed.

As mentioned, the brackets system 10 of the present invention has been described in connection with certain embodiments, configurations and relative dimensions. However, the description above is not to be construed as being absolutely particular. It is to be understood that the description given herein has been given for the purpose of explaining and illustrating the bracket system 10 and is not intended to limit the scope of the invention.

For example, the wall bracket retaining fingers 30 have been described as retaining the trim bracket retention edges 50 by physical contact where the wall bracket retaining fingers 30 are located on the outside of the trim bracket retention edges 50. However, it is also within the scope of the invention for the wall bracket 16 to have a structure virtually identical to the trim bracket retention edges 50 and for the trim bracket 20 to have a structure virtually identical to the wall bracket retaining fingers 30. In this embodiment of the invention, the wall bracket retaining fingers 30 now located on the trim bracket 20 will be on the outside of the trim bracket retention edges 50 now located on the wall bracket 16.

In addition, the specific dimensions and configuration of the components of the bracket system 10 may be varied so long as the dimensions and configurations of the bracket system 10 provide the function of facilitating the removable connection or trim or removable walls. Also, there are many materials and configurations that can be used in constructing the bracket system 10 that will be well understood by those skilled in the art including those being developed or that will be developed. In addition, it is clear than an almost infinite number of minor variations to the form and function of the disclosed bracket system 10 could be made and also still be within the scope of the invention. Consequently, it is not intended that the bracket system 10 be limited to the specific embodiments and variants of the invention disclosed. It is to be further understood that changes and modifications to the descriptions given herein will occur to those skilled in the art. Therefore, the scope of the invention should be limited only by the scope of the claims.

What is claimed is:

1. A bracket system for removably connecting trim to a wall or ceiling or both comprising:

(a) at least one wall bracket that is attachable to at least one of a wall and a ceiling, the wall bracket including:

(i) at least one continuous backplate attachable to the at least one of a wall and a ceiling, the backplate having opposed sides;

(ii) a pair of sets of opposed wall bracket retaining fingers located along each of the opposed sides of the backplate, each set of the opposed wall bracket retaining fingers comprising a plurality of individual retaining fingers spaced apart from each other along an opposed side of the backplate, each retaining finger extending separately with a first segment away from the backplate in a direction outward from the at least one of a wall and ceiling therewith providing an outwardly facing channel with an opening therein;

(b) at least one trim bracket removably attachable to a piece of trim, the trim bracket including:

(i) at least one trim clip each having a trim plate having opposed edges; and (ii) a pair of sets of opposed trim bracket retention edges located on each of the opposite edges of the trim plate, each set of the opposed trim bracket retaining edges comprising a plurality of individual trim bracket retaining edges spaced apart from each other along a side of the backplate, each of the trim bracket retention edges extending separately away from the trim plate a direction inward toward the wall or ceiling;

wherein the wall bracket retaining fingers removably retain the trim bracket against the wall bracket between a plurality of positions including a first position wherein the wall bracket retaining fingers and the trim bracket retention edges are brought into contact with each other; a second position wherein the trim bracket is moved toward the wall bracket so that the wall bracket retaining fingers move past the trim bracket retention edges such that at least one of the wall bracket retaining fingers and the trim bracket retention edges are placed into a stressed or biased position; and a third position wherein the trim bracket is passed through the opening in the channel so that the wall bracket retaining fingers move past the trim bracket retention edges;

whereby in the third position at least one of the wall bracket retaining fingers and the trim bracket retention edges return to an unstressed rest position and the trim bracket is retained in contact with the wall bracket.

2. The bracket system of claim 1 wherein the backplate is substantially planar.

3. The bracket system of claim 1 wherein the wall bracket retaining fingers extend subsequently with a second segment in a direction inward toward the at least one of a wall and a ceiling to form a channel in at least a portion of the backplate between the wall bracket retaining fingers.

4. The bracket system of claim 1 wherein the backplate has at least one backplate hole extending through the backplate to receive a fastener that passes through the backplate hole into a wall or ceiling to hold the backplate in firm contact with the wall or ceiling.

5. The bracket system of claim 1 wherein the wall bracket is segmented to allow flexibility of the wall bracket to follow the shape of a wall or ceiling to which the wall bracket is attached.

6. The bracket system of claim 1 wherein the wall bracket is made of a flexible material to allow flexibility of the wall bracket to follow the shape of a wall or ceiling to which the wall bracket is attached.

7. The bracket system of claim 1 wherein the wall bracket retaining fingers have a height of slightly less than the thickness of a wall covering so that when a trim bracket is mated with the wall bracket, a piece of trim attached to the trim bracket is moved into flush contact with the wall covering.

8. The bracket system of claim 1 wherein the wall bracket is dimensioned so that when attached to a wall or ceiling, the wall bracket is recessed from or flush with the face of the respective wall or ceiling.

9. The bracket system of claim 1 wherein the wall bracket is dimensioned so that when attached to a wall or ceiling, the wall bracket projects out from the face of the respective finished wall or ceiling but is concealed by the trim.

10. The bracket system of claim 1 wherein the wall bracket is continuous between attachment points to a wall or ceiling.

11. The bracket system of claim 1 wherein the wall bracket is discontinuous between attachment points to a wall or ceiling.

12. The bracket system of claim 1 wherein the wall bracket consists of at least two individual segments that are placed at desired attachment points to a wall or ceiling spaced along the length of a piece of trim attached to the trim bracket that will be mated with the wall bracket.

13. The bracket system of claim 1 wherein the trim bracket includes two or more individual trim clips.

14. The bracket system of claim 1 wherein the trim bracket is a single trim clip and wherein the trim plate is substantially a long flat piece.

15. The bracket system of claim 1 wherein each individual trim clip is attached to a piece of trim by a trim bracket fastener.

16. The bracket system of claim 1 wherein each trim plate has at least one trim plate hole extending through the trim plate to receive a trim bracket fastener that passes through the trim plate hole into the trim to hold the trim bracket in firm contact with the trim.

17. The bracket system of claim 1 wherein the trim bracket is segmented to allow flexibility of the trim bracket to follow the shape of the wall bracket to which it is attached.

18. The bracket system of claim 1 wherein the trim bracket is made of a flexible material to allow flexibility of the trim bracket to follow the shape of the wall bracket to which it is attached.

19. The brackets system of claim 1 wherein the trim bracket retention edges have a trim bracket most outer edge and a trim bracket ultimate end that curves inwardly forming a trim bracket lip.

20. The bracket system of claim 1 wherein the trim bracket has a length similar to the length of a piece of trim attached to the trim bracket that will be mated with the wall bracket.

21. The bracket system of claim 1 wherein the trim bracket consists of at least two individual segments that are placed at desired attachment points to a piece of trim spaced along the length of a piece of trim.

22. The bracket system of claim 1 further comprising an insert bracket including a body having a face plane, side edges and insert bracket retaining edges on each side of the insert bracket extending away from the side edges wherein the insert bracket is placed inside and concealed within the wall bracket.

23. The bracket system of claim 22 wherein the body of the insert bracket is elongated and spans substantially the entire length of its corresponding wall bracket.

24. The bracket system of claim 22 wherein the insert bracket is attached to a wall or ceiling with fasteners.

25. The bracket system of claim 22 wherein the insert bracket is made of a deformable material and shaped so that the insert bracket is deformed to place or remove the insert bracket from the wall bracket and otherwise holds its form within the wall bracket.

26. The bracket system of claim 22 wherein the insert bracket further comprises at least one groove located in the face plane.

27. The bracket system of claim 22 wherein the height of the side edges is less than the height of either the wall bracket or trim bracket.

28. The bracket system of claim 1 further comprising multiple rows of wall brackets and corresponding trim brackets wherein several parallel trim brackets are securely attached to a piece of trim.

29. The bracket system of claim 1 wherein the trim is placed around the outside of a window frame.

30. The bracket system of claim 1 wherein the trim is placed around the outside of a door frame.

31. The bracket system of claim 1 wherein the trim is placed around the inside of a window frame.

32. The bracket system of claim 1 wherein the trim covers the outside of a corner.

33. The bracket system of claim 1 wherein a distance between individual trim bracket retaining edges is greater than a distance between individual retaining fingers.

34. The bracket system of claim 33, wherein the wall bracket includes a greater number of individual retaining fingers than individual retaining edges of the trim clip.

35. A method of removably connecting trim to a wall or ceiling or both comprising the steps of:

(a) providing a bracket system for removably connecting trim to a wall or ceiling or both comprising:

(i) at least one wall bracket that is attachable to a wall or ceiling or both, the wall bracket including:

(A) a continuous backplate that is attachable to a wall or ceiling, the backplate having opposed sides;

(B) a pair of opposed wall bracket retaining fingers located along the opposed sides of the backplate, each of the opposed wall bracket retaining fingers comprising a plurality of individual retaining fingers spaced apart from each other along an opposed side of the backplate, each retaining finger extending separately away from the backplate on the same side of the backplate in a direction substantially perpendicular to the plane of the backplate;

(ii) at least one trim bracket that is removably attachable to trim, the trim bracket being attachable to a piece of trim, the trim bracket including:

(A) at least one trim clip each having a trim plate having opposed edges; and (B) a pair of opposed trim bracket retention edges located on opposite edges of the trim plate, the pair of opposed trim bracket retaining edges comprising a plurality of individual trim bracket retaining edges spaced apart from each other along a side of the backplate, each of the trim bracket retention edges being located on opposite sides of the trim plate and extending separately away from the trim plate in the same direction;

wherein the height of the wall bracket retaining fingers is such that a trim bracket is retained against the backplate by contact between the wall bracket retaining fingers and the trim bracket;

(b) bringing the trim bracket retention edges into contact with the wall bracket retaining fingers;

(c) moving the trim bracket toward the wall bracket so that the wall bracket retaining fingers move past the trim bracket retention edges and move either or both the wall bracket retaining fingers or the trim bracket retention edges from a unstressed rest position to a stressed or biased position;

(d) moving the trim bracket retention edges past the wall bracket retaining fingers so that either or both the wall bracket retaining fingers or the trim bracket retention edges move from a stressed or biased position to an unstressed or rest position so that the trim bracket is retained in close contact with the wall bracket by contact between the trim bracket retention edge and the wall bracket retaining finger moving the trim bracket toward the wall bracket so that the wall bracket retaining fingers move past the trim bracket retention edges.

36. A method of removably connecting trim to a wall or ceiling or both comprising the steps of:

(a) providing a bracket system for removably connecting trim to a wall or ceiling or both comprising:

(i) at least one wall bracket that is attachable to a wall or ceiling or both, the wall bracket including:

at least one continuous backplate attachable to at least one of the wall and the ceiling, the backplate having opposed sides;

a pair of sets of opposed wall bracket retaining fingers located along each of the opposed sides of the backplate, each set of the opposed wall bracket retaining fingers comprising a plurality of individual retaining fingers spaced apart from each other along an opposed side of the backplate, each retaining finger extending separately with a first segment away from the backplate in a direction outward from the at least one of the wall and the ceiling therewith providing an outwardly facing channel with an opening therein;

(ii) at least one trim bracket that is attachable to trim, the trim bracket being attachable to a piece of trim, the trim bracket including:

at least one trim clip each having a trim plate having opposed edges;

a pair of sets of opposed trim bracket retention edges located on each of the opposite edges of the trim plate, each set of the opposed trim bracket retaining edges comprising a plurality of individual trim bracket retaining edges spaced apart from each other along a side of the backplate, each of the trim bracket retention edges extending separately away from the trim plate a direction inward toward the at least one of the wall and the ceiling; and (iii) means for interlocking the wall bracket and trim bracket with each other so that the wall bracket and the trim bracket are pushed together in mating contact and pulled apart to allow for removal and reinstallation of trim without mechanical modification or destruction of any components;

(b) bringing the means for interlocking the wall bracket and trim bracket with each other together; and (c) retaining the trim bracket in close contact with the wall bracket.

37. A system of modular walls comprising:

(a) at least one movable wall;

(b) at least one wall bracket that is attachable to the wall, the wall bracket including:

at least one continuous backplate attachable to the wall, the backplate having opposed sides;

a pair of sets of opposed wall bracket retaining fingers located along each of the opposed sides of the backplate, each set of the opposed wall bracket retaining fingers comprising a plurality of individual retaining fingers spaced apart from each other along an opposed side of the backplate, each retaining finger extending separately with a first segment away from the backplate in a direction outward from the wall therewith providing an outwardly facing channel with an opening therein;

(c) at least one trim bracket that is attachable to trim, the trim bracket being attachable to a piece of trim, the trim bracket including:

at least one trim clip each having a trim plate having opposed edges;

a pair of sets of opposed trim bracket retention edges located on each of the opposite edges of the trim plate, each set of the opposed trim bracket retaining edges comprising a plurality of individual trim bracket retaining edges spaced apart from each other along a side of the backplate, each of the trim bracket retention edges extending separately away from the trim plate a direction inward toward the wall;

(d) means for interlocking the wall bracket and trim bracket with each other so that the wall bracket and the trim bracket are pushed together in mating contact and pulled apart to allow for removal and reinstallation of trim without mechanical modification or destruction of any components.

38. A method of installing a modular wall to either flooring, another wall or a ceiling comprising the steps of:

(a) providing at least one movable wall;

(b) providing at least one wall bracket, the wall bracket including:

at least one continuous backplate attachable to either the movable wall or the flooring, other wall or ceiling, the backplate having opposed sides;

a pair of sets of opposed wall bracket retaining fingers located along each of the opposed sides of the backplate, each set of the opposed wall bracket retaining fingers comprising a plurality of individual retaining fingers spaced apart from each other along an opposed side of the backplate, each retaining finger extending separately with a first segment away from the backplate in a direction outward from either the movable wall or the flooring, other wall or ceiling therewith providing an outwardly facing channel with an opening therein;

(c) attaching the wall bracket to either the movable wall or the flooring, other wall or ceiling;

(d) providing at least one trim bracket, the trim bracket including:

at least one trim clip each having a trim plate having opposed edges;

a pair of sets of opposed trim bracket retention edges located on each of the opposite edges of the trim plate, each set of the opposed trim bracket retaining edges comprising a plurality of individual trim bracket retaining edges spaced apart from each other along a side of the backplate, each of the trim bracket retention edges extending separately away from the trim plate a direction inward toward either the movable wall or the flooring, other wall or ceiling;

(e) attaching the trim bracket to the flooring, other wall or ceiling if the wall bracket is attached to the movable wall or to the movable wall if the wall bracket is attached to the flooring, other wall or ceiling;

(f) moving the wall bracket next to the trim bracket if the wall bracket is attached to the movable wall or moving the trim bracket next to the wall bracket if the trim bracket is attached to the movable wall;

(g) pushing the wall bracket and trim bracket into mating contact.

* * * * *